US011913234B2

(12) United States Patent
Jansen van Vuuren et al.

(10) Patent No.: US 11,913,234 B2
(45) Date of Patent: Feb. 27, 2024

(54) CLADDING ATTACHMENT DEVICES, SYSTEMS, AND ASSOCIATED METHODS OF MANUFACTURE AND USE

(71) Applicant: 0776425 B.C. LTD., Abbotsford (CA)

(72) Inventors: Stefanus H Jansen van Vuuren, Chilliwack (CA); Michael D. Heppell, Abbotsford (CA); Aaron C. Fraser, Chilliwack (CA)

(73) Assignee: 0776425 B.C. LTD., Abbotsford (CA)

( * ) Notice: Subject to any disclaimer, the term of this patent is extended or adjusted under 35 U.S.C. 154(b) by 58 days.

(21) Appl. No.: 17/463,442

(22) Filed: Aug. 31, 2021

(65) Prior Publication Data

US 2023/0069389 A1 Mar. 2, 2023

(51) Int. Cl.

| | |
|---|---|
| ***E04B 1/74*** | (2006.01) |
| ***E04B 1/38*** | (2006.01) |
| ***E04B 1/76*** | (2006.01) |
| ***E04F 13/08*** | (2006.01) |

(52) U.S. Cl.
CPC ..... *E04F 13/0805* (2013.01); *E04B 1/388* (2023.08); *E04B 1/7629* (2013.01)

(58) Field of Classification Search
CPC .... E04F 13/0805; E04F 13/0807; E04B 1/40; E04B 1/7629; E04B 1/388
USPC ..... 52/731.2, 118, 250
See application file for complete search history.

(56) References Cited

U.S. PATENT DOCUMENTS

| | | | | |
|---|---|---|---|---|
| 336,414 | A * | 2/1886 | Kerr | A62B 1/02 52/118 |
| 3,251,168 | A | 5/1966 | Waring et al. | |
| 3,308,588 | A | 3/1967 | Von Wedel | |
| 3,453,795 | A | 7/1969 | Heirich | |
| 3,467,418 | A * | 9/1969 | Redditt | F16B 9/052 182/229 |
| 3,507,082 | A | 4/1970 | Heirich | |
| 3,513,613 | A | 5/1970 | Jones et al. | |
| 3,626,650 | A | 12/1971 | Lickliter et al. | |
| 3,667,183 | A | 6/1972 | Heirich | |
| 3,972,168 | A | 8/1976 | Allen | |

(Continued)

FOREIGN PATENT DOCUMENTS

| | | |
|---|---|---|
| EP | 2918746 A2 | 9/2015 |
| EP | 2918746 B1 | 1/2017 |
| WO | 2008101319 A1 | 8/2008 |

OTHER PUBLICATIONS

RDH Building Engineering Ltd., RDH Building Sciences Inc., and Rockwool Inc., "Cladding Attachment Solutions for Exterior Insulated Commercial Walls," Graham et al., Dec. 2015, 20 pages.

(Continued)

*Primary Examiner* — Basil S Katcheves

(74) *Attorney, Agent, or Firm* — Perkins Coie LLP

(57) ABSTRACT

Devices, systems and methods for attaching girts, rails, cladding, and/or other cladding components to an exterior wall portion (e.g., an insulated exterior wall portion) or other substructure of a building are disclosed herein. In some embodiments, cladding component attachment devices disclosed herein can include a unitary body formed from a workpiece having a rectangular cross-section. Other embodiments of cladding component attachment devices disclosed herein can include a support arm (e.g., a tubular member) that can be adjustably attached to a base.

22 Claims, 19 Drawing Sheets

(56) References Cited

U.S. PATENT DOCUMENTS

| | | | | |
|---|---|---|---|---|
| 4,111,096 | A | 9/1978 | Fasth | |
| 4,438,611 | A | 3/1984 | Bryant | |
| 4,553,366 | A | 11/1985 | Guerin | |
| 4,765,108 | A | 8/1988 | Lapish | |
| 4,844,648 | A * | 7/1989 | Fentiman | E04B 1/2403 403/171 |
| 5,118,069 | A | 6/1992 | Muhlethaler | |
| 5,144,780 | A * | 9/1992 | Gieling | F16B 7/04 52/298 |
| 5,347,781 | A | 9/1994 | Hanlon | |
| 5,590,974 | A * | 1/1997 | Yang | A47B 47/005 403/171 |
| 5,605,410 | A * | 2/1997 | Pantev | F16B 7/0486 403/174 |
| 5,820,289 | A * | 10/1998 | Kern | H05K 7/183 403/231 |
| 5,997,117 | A * | 12/1999 | Krietzman | H02B 1/301 403/219 |
| 6,029,954 | A * | 2/2000 | Murdaca | E04F 11/1851 256/65.14 |
| 6,398,193 | B1 * | 6/2002 | DeSouza | E04H 17/1488 256/65.06 |
| 6,886,790 | B2 | 5/2005 | Soyris | |
| 6,948,704 | B2 * | 9/2005 | Forbis | E04F 11/1817 256/65.08 |
| 7,427,055 | B2 * | 9/2008 | Platt | E04H 17/1488 256/65.05 |
| 7,562,504 | B2 | 7/2009 | Herbst et al. | |
| 8,429,866 | B2 | 4/2013 | Knight et al. | |
| 8,726,583 | B2 * | 5/2014 | Verdecia | E04B 1/24 52/220.1 |
| 8,739,483 | B1 | 6/2014 | Bilge | |
| 8,875,467 | B2 | 11/2014 | Anastasi | |
| 9,366,055 | B1 * | 6/2016 | Wright | E06B 3/9641 |
| 9,499,974 | B2 | 11/2016 | Bombino et al. | |
| 9,605,425 | B1 * | 3/2017 | Hendry | E04B 1/40 |
| 9,783,992 | B2 | 10/2017 | Bombino et al. | |
| 10,206,506 | B1 * | 2/2019 | Lai | A47B 96/1433 |
| 10,316,508 | B1 * | 6/2019 | Hendry | E04B 1/5831 |
| D939,106 | S * | 12/2021 | Styrc | D25/133 |
| 2003/0205009 | A1 | 11/2003 | Herbst et al. | |
| 2005/0193680 | A1 * | 9/2005 | Wang | E06B 3/9688 52/656.9 |
| 2005/0241250 | A1 | 11/2005 | Tarr | |
| 2006/0179762 | A1 | 8/2006 | Thome et al. | |
| 2007/0022683 | A1 | 2/2007 | McGee et al. | |
| 2008/0017780 | A1 | 1/2008 | Downey et al. | |
| 2009/0145071 | A1 | 6/2009 | Radford | |
| 2010/0031597 | A1 | 2/2010 | Baek | |
| 2010/0325997 | A1 | 12/2010 | Scully | |
| 2011/0000160 | A1 | 1/2011 | Sarayli | |
| 2011/0185659 | A1 | 8/2011 | Lorenz | |
| 2012/0137610 | A1 | 6/2012 | Knight et al. | |
| 2012/0174516 | A1 | 7/2012 | Mann | |
| 2012/0297725 | A1 | 11/2012 | Anastasi | |
| 2013/0074431 | A1 | 3/2013 | Croasdale | |
| 2013/0174506 | A1 | 7/2013 | Bombino et al. | |
| 2013/0291465 | A1 | 11/2013 | Resso | |
| 2013/0306808 | A1 * | 11/2013 | Huang | A47B 13/06 248/163.1 |
| 2013/0312352 | A1 | 11/2013 | Gale | |
| 2014/0075855 | A1 | 3/2014 | Hohmann, Jr. | |
| 2014/0083042 | A1 * | 3/2014 | Hiragaki | E04B 1/40 52/655.1 |
| 2014/0305063 | A1 | 10/2014 | Kim | |
| 2015/0128518 | A1 | 5/2015 | Knight et al. | |
| 2016/0289977 | A1 * | 10/2016 | Lucchese | E04F 13/0819 |
| 2017/0233996 | A1 * | 8/2017 | Abernathy | F16B 7/182 52/698 |
| 2018/0094426 | A1 * | 4/2018 | Winter | E04B 1/2403 |
| 2018/0187411 | A1 * | 7/2018 | Shang | F24S 25/636 |
| 2018/0202143 | A1 * | 7/2018 | Vanker | E04B 1/40 |
| 2018/0223526 | A1 * | 8/2018 | Schillinger | E04B 1/165 |
| 2018/0320362 | A1 * | 11/2018 | Wheatley | E04B 1/215 |
| 2023/0069389 | A1 | 3/2023 | Vuuren et al. | |

OTHER PUBLICATIONS

Rockwool Group, "Cladding Attachment Solutions For Exterior Insulated Commercial Walls," RDH Building Engineering Ltd. and RDH Building Sciences Inc., Graham et al., Dec. 2017, 16 pages.

Armatherm Z Girt Structural Thermal Break Cladding Attachment (https://www.armatherm.com/thermal-break-materials/armatherm-z-girt/), last accessed Jan. 18, 2022, 4 pages.

Eco Cladding, Cladding Systems, (https://www.ecocladding.com/systems), last accessed Jan. 18, 2022, 7 pages.

ISO Clip, Thermal Clip For Exterior Wall Assemblies (https://isoclips.com/), May 4, 2021, 12 pages.

TCLIP™ Building Envelope System (https://www.engineeredassemblies.com/en/systems/tclip%E2%84%A2-thermally-broken-facade-structure), Engineered Assemblies Inc., last accessed Jan. 18, 2022, 2 pages.

Nvelope, NH2 System Horizontal Cladding Attachment, (https://www.nvelope.com/cladding-systems-NH2-horizontal-cladding.php), last accessed Jan. 18, 2022, 4 pages.

ACS Composite Systems, Inc., Thermal Break Wall Systems, (http://acscompositesystems.com/thermal-wall-break-systems/), last accessed Jan. 18, 2022.

SMARTci Systems, SMARTci GreenGirt Clip, (https://smartcisystems.com/products/smartci-greengirt-clips/), last accessed Jan. 18, 2022, 3 pages.

International Search Report and Written Opinion for PCT International Patent Application No. PCT/CA2022/051191, 12 pages.

International Search Report and Written Opinion for PCT International Patent Application No. PCT/CA2023/050369, 7 pages.

* cited by examiner 110b
316a
340
342b
316b
334a
334b
342a
308
344a
336a
336b
346
310
314a
314b
328a
328c
328b
304
326a
324
322a
320
326b
322b
312b
312a
330a
318
330b
332a
306
332c
330c
332b
302
T

CLADDING ATTACHMENT DEVICES, SYSTEMS, AND ASSOCIATED METHODS OF MANUFACTURE AND USE

TECHNICAL FIELD

The present disclosure is generally related to devices, systems, and associated methods for attaching cladding and/or other materials to building structures.

BACKGROUND

The construction and operation of buildings accounts fora significant portion of global energy-related carbon emissions. In recent years, there has been a focus on energy efficiency and the construction of better-insulated buildings. There are various ways of insulating the exterior walls of a building, and some of the most efficient methods include the use of "continuous" insulation with minimal thermal bridging across the building wall to limit thermal energy losses.

Cladding is typically applied to the exterior surfaces of buildings to provide a degree of thermal insulation and weather resistance, and often to improve the appearance of the building. Cladding can be made from a wide variety of materials in different forms including, for example, aluminum and other metals, wood, brick, vinyl, and composite materials that can include blends of cement and recycled polystyrene, etc. Cladding can be applied over insulation with clips or anchors that are fastened to the building wall and extend through the insulation to support the cladding directly or via an arrangement of girts, rails, etc.

DETAILED DESCRIPTION

Figure 1:
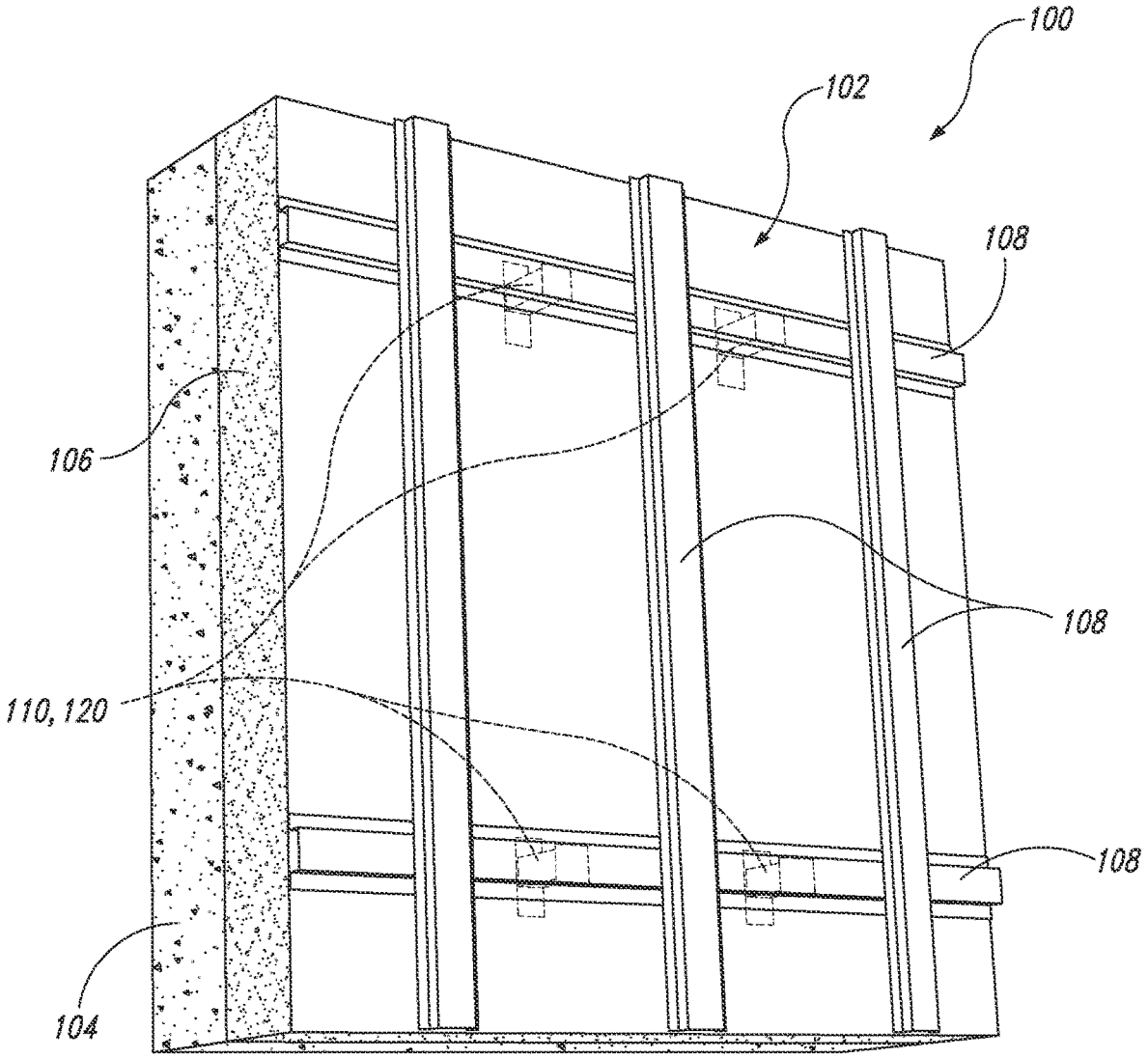
FIG. 1 is an isometric view of a portion of an exterior wall assembly of a building having a cladding attachment system configured in accordance with some embodiments of the present technology.

The following disclosure describes various embodiments of devices, systems, and associated methods for attaching cladding components to a wall (e.g., a continuously or near-continuously insulated exterior wall) or other substructure of a building. Unless the context clearly requires otherwise, the term "cladding component" is used herein for ease of reference to generally refer to any cladding support component or cladding material that may be attached to an exterior wall of a building. By way of non-limiting examples, such cladding components can include girts, rails, and/or other cladding support components, as well as cladding boards, panels, sheets, and other cladding materials. As described in greater detail below, various embodiments of the devices and systems described herein are modular devices and systems that can provide thermally insulated intermittent structural attachment solutions for attaching various types of cladding systems onto exterior wall assemblies having a relatively wide range of different insulation thicknesses. For example, some cladding component attachment devices configured in accordance with embodiments of the present technology include a body formed from a tube (e.g., a steel tube) having a square or rectangular cross-section. In some of these embodiments, the tube can be cut, bent and/or otherwise processed during manufacturing to form the body so that it has fastening features on one side wall of the tube for attachment to a building wall structure, and a face on an opposite side wall of the tube onto which girts, rails, or other cladding support components can be attached in various orientations. As described in greater detail below, by using tubes of different cross-sectional size, the length or depth of the attachment device body can be varied to accommodate a range of different insulation thicknesses. Other cladding component attachment devices configured in accordance with embodiments of the present technology can include a body that at least partially includes a support arm (e.g., a steel tube having a square cross-section) that is attached to a base which is in turn configured to be attached to a building wall structure. In these embodiments, the support arm extends outwardly from the wall and can include features for adjusting the length of the device if needed to account for the wall or substructure not being plumb.

Certain details are set forth in the following description and in FIGS. 1-14D to provide a thorough understanding of various embodiments of the present technology. In other instances, well-known structures, materials, operations and/or systems often associated with cladding, cladding support components and systems, insulation, building structures, etc. are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

The terminology used below is to be interpreted in its broadest reasonable manner, even though it is being used in conjunction with a detailed description of certain examples of embodiments of the present technology. Indeed, certain terms may even be emphasized below; however, any terminology intended to be interpreted in any restricted manner will be overtly and specifically defined as such in this Detailed Description section. Unless the context clearly requires otherwise, as used herein the terms "about," "generally," "substantially," and "approximately" refer to values within 10% of the stated value. In instances in which relative terminology is used in reference to something that does not include a numerical value, the terms are given their ordinary meaning to one skilled in the art.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the invention. Many of the details, dimensions, angles and other features shown in the Figures are merely illustrative of particular embodiments of the present technology. Accordingly, other embodiments can have other details, dimensions, angles and features without departing from the present disclosure. In addition, those of ordinary skill in the art will appreciate that further embodiments of the present technology can be practiced without several of the details described below. In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

FIG. 1 is an isometric view of a portion of an exterior wall assembly 100 having a cladding attachment system 102 configured in accordance with some embodiments of the present technology. The exterior wall assembly 100 can be an insulated exterior wall of a building, such as a commercial building, a residential building, etc., and can include insulation 106 that is positioned on an exterior side of an exterior wall 104. By way of example, the exterior wall 104 can form part of the building's primary structure, and can be comprised of concrete, wood, sheathing, studs (e.g., steel studs such as C-channel steel studs), or essentially any other type of exterior wall structure typically found on buildings, such as commercial buildings, residential buildings, etc. By way of example, the insulation 106 can include a mineral wool (e.g., ROCKWOOL®), foam boards or blocks (e.g., polystyrene, polyisocyanurate, polyurethane), loose-fill or blown-in insulation (e.g., cellulose, fiberglass, other mineral (rock or slag) wool), etc., as well as other types of known building insulation materials.

The cladding attachment system 102 can include a plurality of cladding component attachment devices 110, or a plurality of cladding component attachment devices 120, that extend through the exterior insulation 106 and structurally attach a plurality of cladding components 108 to the building wall 104. In some embodiments, the cladding components 108 are elongate girts (e.g., galvanized steel girts having "hat-shaped" cross-sections). In other embodiments, however, the cladding component attachment devices described herein can be used to attach a wide variety of different cladding support components to the building wall 104, including, for example, other types of girts, rails, and/or other types of secondary framing having various cross-sectional shapes (e.g., hat-shaped, Z-shaped, C-shaped, flat, etc.). Accordingly, although portions of the present disclosure describe the cladding component attachment devices 110, 120 for use in attaching girts to exterior building walls, it will be understood that the cladding component attachment devices 110, 120 and various embodiments thereof can be used to attach a wide variety of cladding and/or cladding support components to building walls in accordance with the present technology. Although referred to herein as "cladding component attachment devices 110, 120," in some embodiments, the attachment devices 110, 120 can also be referred to as "clips," "brackets," and the like. Similarly, in some embodiments, the cladding attachment system 102 can be referred to as a "clip and rail" attachment system, a "panel" attachment system, an "exterior finish" attachment system, and the like.

Although exterior cladding is not illustrated in FIG. 1, those of ordinary skill in the art will understand that the cladding components 108 can support a wide variety of different types of cladding and facades including, for example, Longboard® siding (which is extruded, architectural-grade aluminum siding provided by Mayne, Inc. of 1777 Clearbrook Road, Abbotsford, BC, Canada), other types of metal (e.g., aluminum) cladding and panels, fiber cement panels, phenolic panels, aluminum composite material (ACM) panels, etc. Accordingly, the cladding component attachment devices and cladding attachment systems described herein are not limited to use with any particular type of cladding support component or arrangement, and/or any particular type of cladding or other exterior finish material, unless the context clearly requires otherwise.

Figure 2B:
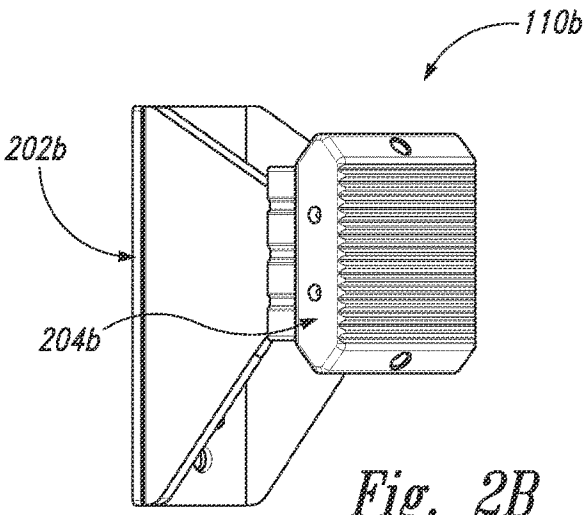
FIGS. 2A-2D are side isometric views of cladding component attachment devices configured in accordance with some embodiments of the present technology.
Figure 2D:
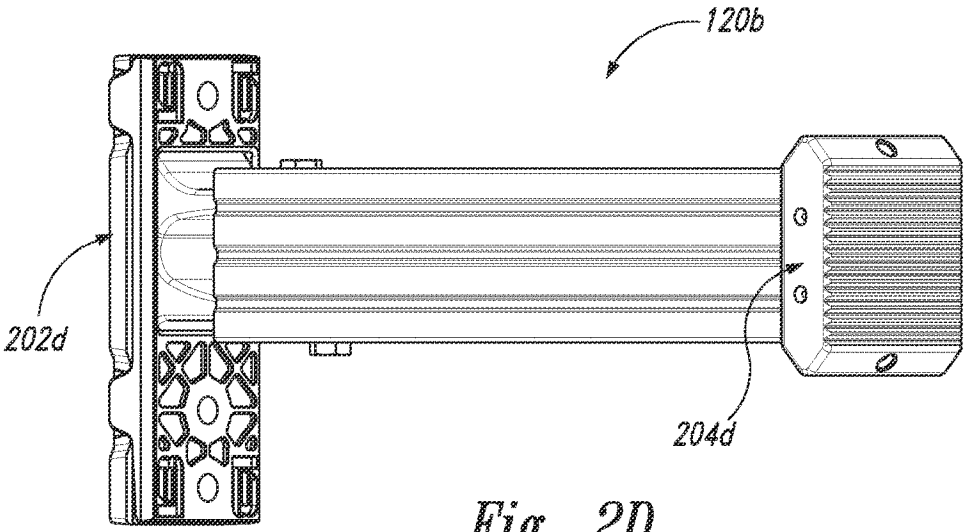
Figure 2A:
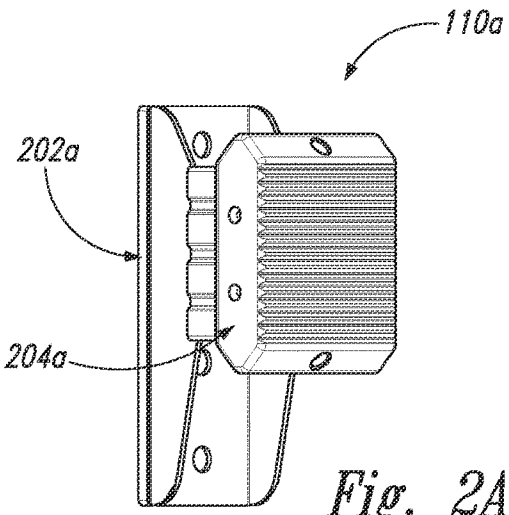
Figure 2C:
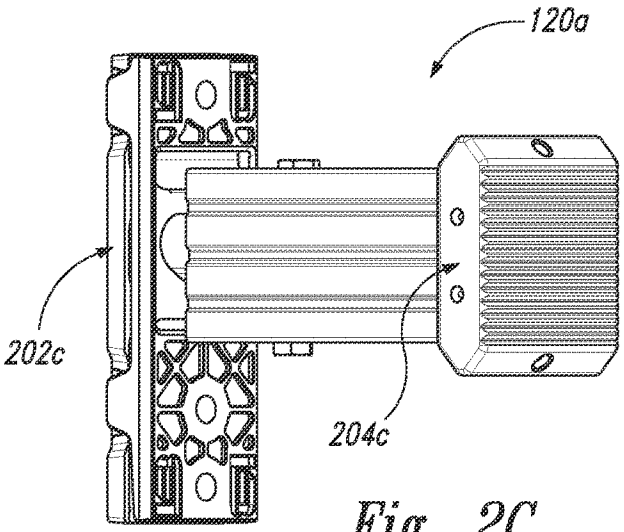

FIGS. 2A and 2B are side isometric views of cladding component attachment devices 110*a* and 110*b*, respectively, and FIGS. 2C and 2D are side isometric views of cladding component attachment devices 120*a* and 120*b*, respectively, configured in accordance with embodiments of the present technology. Referring to FIGS. 2A-2D together, each of the cladding component attachment devices 110*a, b* and 120*a, b* includes a base portion 202 (identified individually as base portions 202*a-d*, respectively) configured to be fastened to an exterior wall of a building, and a distal end portion 204 (identified individually as distal end portions 204*a-d*, respectively) configured to support a cladding support member, such as a girt, rail, or other cladding component. The cladding component attachment devices 110*a* and 110*b* shown in FIGS. 2A and 2B, respectively, represent two embodiments of a first version of an attachment device that can accommodate a first range of insulation thicknesses, and the cladding component attachment devices 120*a* and 120*b* shown in FIGS. 2C and 2D, respectively, represent two embodiments of another version of an attachment device that can accommodate greater thicknesses of wall insulation.

Figures 3A, 3B:
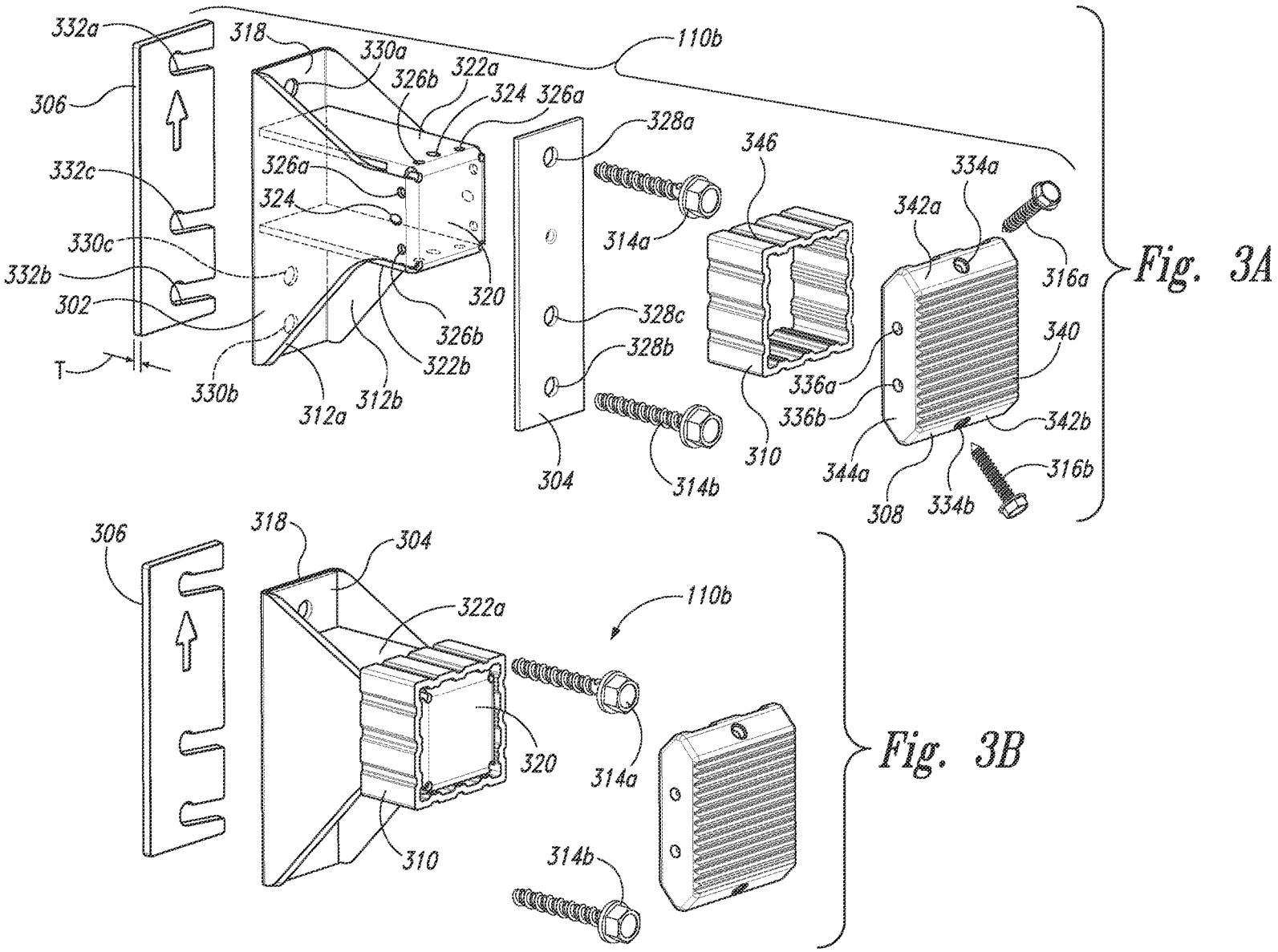
FIGS. 3A-3C are a series of partially exploded isometric views of a cladding component attachment device configured in accordance with some embodiments of the present technology.
Figure 3C:
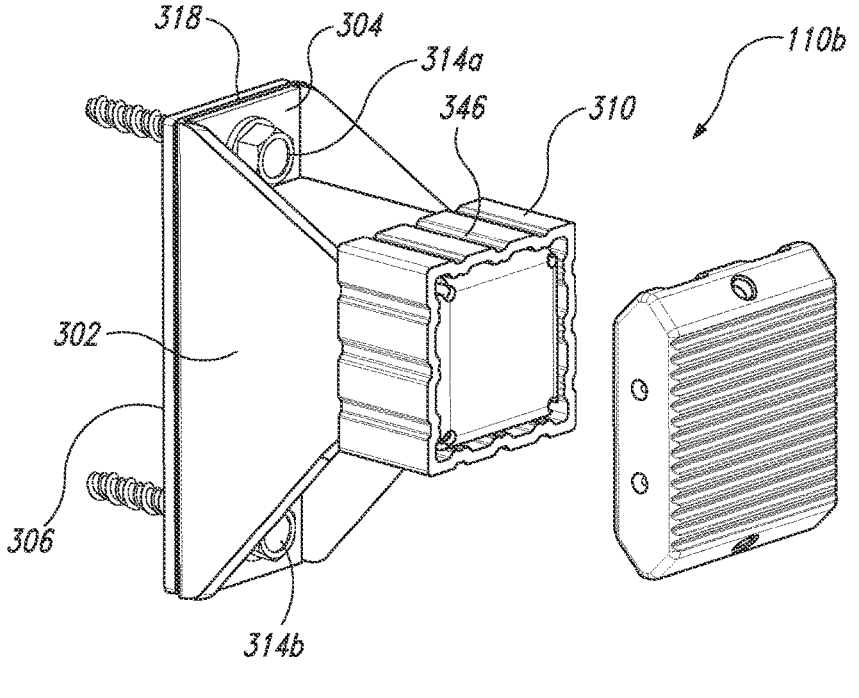
Figure 3D:
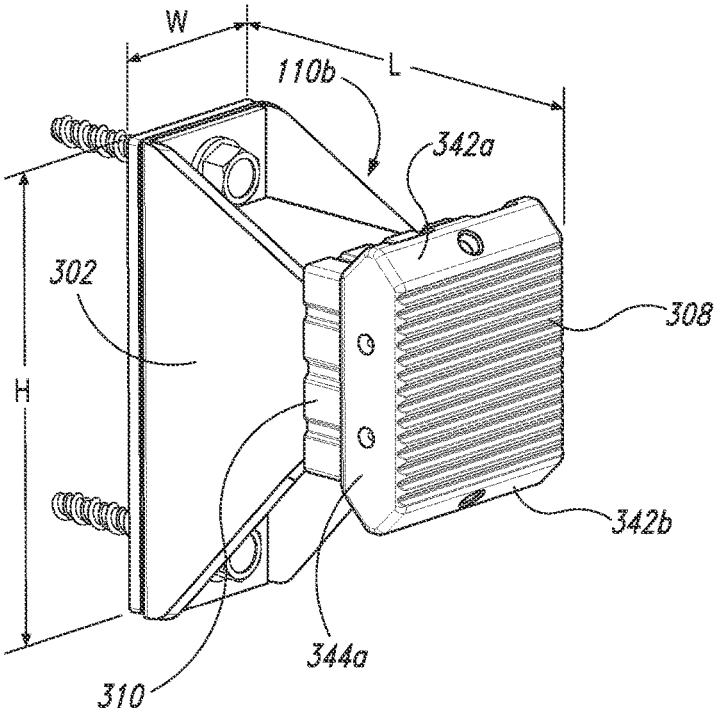
FIG. 3D is an assembled isometric view of the cladding component attachment device of FIGS. 3A-3C.

FIGS. 3A-3C are a series of partially exploded isometric views of the cladding component attachment device 110*b* configured in accordance with embodiments of the present technology, and FIG. 3D is an assembled isometric view of the attachment device 110*b*. Although the cladding component attachment device 110*b* is described herein by way of example, it will be understood that the cladding component attachment device 110*a* is generally the same, or is at least generally similar, in structure and function to the cladding component device 110*b*, with the principle difference being that the body 302 of the attachment device 110*b* is longer than the body of the attachment device 110*a* and thus can be used with insulation of greater thickness. Accordingly, it will be understood that the cladding component attachment device 110*a* can be manufactured and used in the same manner, or at least generally the same manner, as the cladding component attachment device 110*b*. For ease of reference, the cladding component attachment device 110*b* and the other cladding component attachment devices described herein may be referred to at various times as a "component attachment device," an "attachment device," or even simply "a device."

Referring first to FIG. 3A, the attachment device 110*b* includes a body 302 having first and second side walls 312*a* and 312*b*, respectively, extending between a base wall 318 and a distal end wall 320. In the illustrated embodiment, the body 302 also includes third and fourth side walls 322*a* and 322*b*, respectively, which are continuous with the end wall 320 and extend from the end wall 320 toward the base wall 318. More specifically, in this embodiment, the third side wall 322*a* extends between the first side wall 312*a* and the second side wall 312*b* toward an upper portion of the body 302, and the fourth side wall 322*b* extends between the first side wall 312*a* and the second side wall 312*b* toward a lower portion of the body 302. In some embodiments, the side walls 312*a, b* and 322*a, b* together define a rectangular cross-sectional shape, e.g., a square cross-sectional shape, in which each side wall 312*a, b* and 322*a, b* has a width of from about 1 inch to about 3 inches, from about 1 inch to about 2 inches, or about 1.5 inches. In other embodiments, the side walls 312*a, b* and 322*a, b* can form a square cross-sectional shape of other sizes. In some embodiments, use of a rectangular or square shape for the distal end portion of the body 302 has the benefit of providing a shape with multiple flat surfaces that components (e.g., cladding components) can be fastened to.

The base wall 318 includes a plurality of fastener holes 330 (identified individually as fastener holes 330*a-c*) that, as described in greater detail below, are configured to receive fasteners 314*a, b* (e.g., threaded fasteners) which extend therethrough for fixedly attaching the body 302 to a surface of an exterior wall of a building or other building structure. The fasteners 314*a, b* can be appropriately selected based on the type of wall material (e.g., concrete, wood, metal, etc.) that the device 110*b* will be attached to. In some embodiments, each of the side walls 312*a, b* and 322*a, b* includes the same pattern of fastener holes 324 and 326*a, b* positioned adjacent to, or at least toward, the distal end wall 320 of the body 302. In the illustrated embodiment, each of the fastener holes 324 is generally aligned with the midpoint of the adjacent edge of the end wall 320, and the centerline or longitudinal axis of the fastener holes 324 is positioned at an angle (e.g., a 45° angle) relative to the surface of the corresponding side wall 312*a, b* and 322*a, b*. As described in greater detail below, in some embodiments, the fastener holes 324 are positioned at an angle to align with and receive fasteners 316*a, b*. In some embodiments, the fastener holes 324 can initially be unthreaded (untapped), and the fasteners 316*a, b* can be self-tapping fasteners (e.g., stainless-steel self-tapping fasteners having a diameter of, e.g., from about 0.12 inch to about 0.25 inch, or about 0.19 inch) for attaching a cladding component (e.g., a girt, rail, adapter, accessory, etc.) to the body 302 via an end cap 308 or otherwise. In other embodiments, the holes 324 can be threaded before fastener installation and/or the fasteners 316*a, b* can be other types of fasteners having other sizes. In the illustrated embodiment, the fastener holes 326*a, b* on each side wall 312*a, b* and 322*a, b* are positioned on opposite sides of the corresponding fastener hole 324 with centerlines that extend perpendicular to the surface of the corresponding side wall 312*a, b* and 322*a, b*. As described in greater detail below, in some embodiments, one or more of the fastener holes 326*a, b* can receive a fastener for attaching a cladding component (e.g., a girt, rail, etc.) to the body 302 via the end cap 308 or otherwise. In some embodiments, the fastener holes 326*a, b* can initially be unthreaded and configured to receive self-tapping fasteners. In other embodiments, the fastener holes 326*a, b* can be threaded before fastener installation.

The foregoing description of the fastener holes 324 and 326*a, b* is provided by way of example only. Accordingly, in other embodiments, the body 302 can include other arrangements of fastener holes and/or other attachment features for attaching the end cap 308 and/or a cladding component to the body 302. For example, in some embodiments, the distal end wall 320 can include one or more fastener holes (not shown) in addition to, or in place of, the fastener holes 324 and 326*a, b* for attaching the end cap 308 and/or a cladding component to the body 302. In yet other embodiments, other fastener hole arrangements can be used, or one or more of the fastener holes 324 and 326*a, b* can be omitted.

Figure 4A:
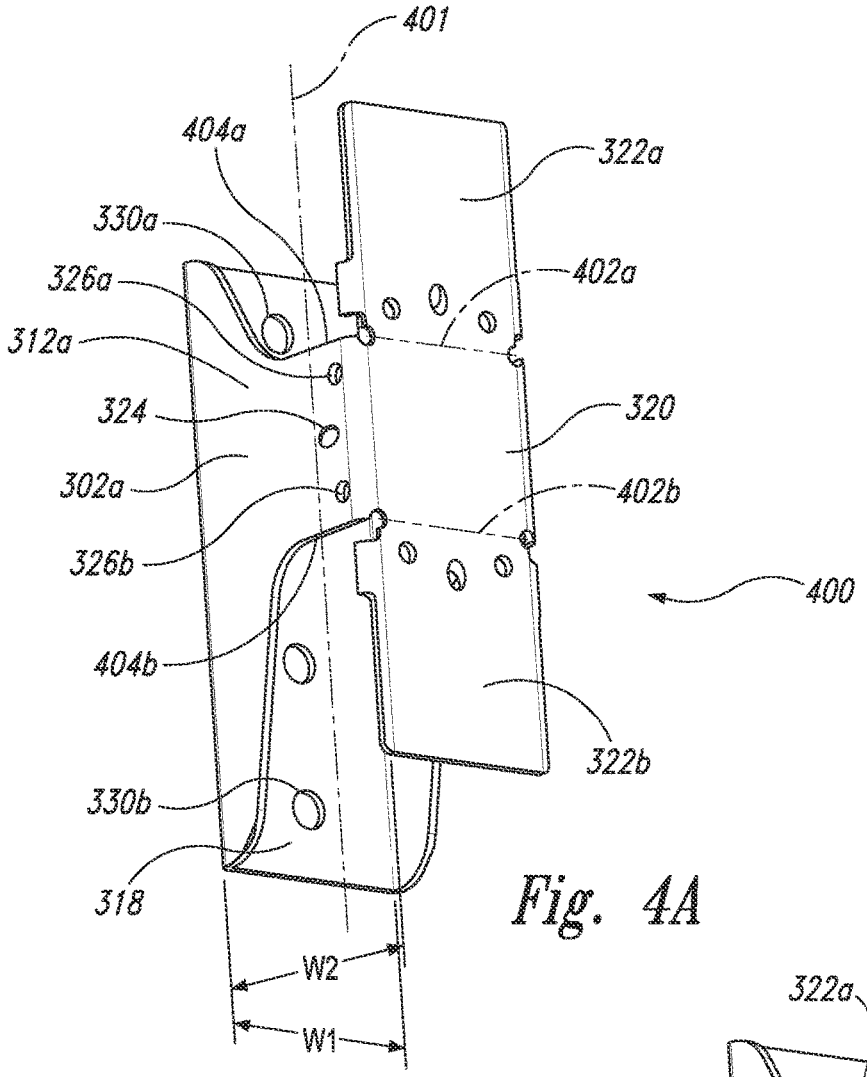
FIGS. 4A and 4B are isometric views illustrating two stages of forming a workpiece into a cladding component attachment device in accordance with some embodiments of the present technology.
Figure 4B:
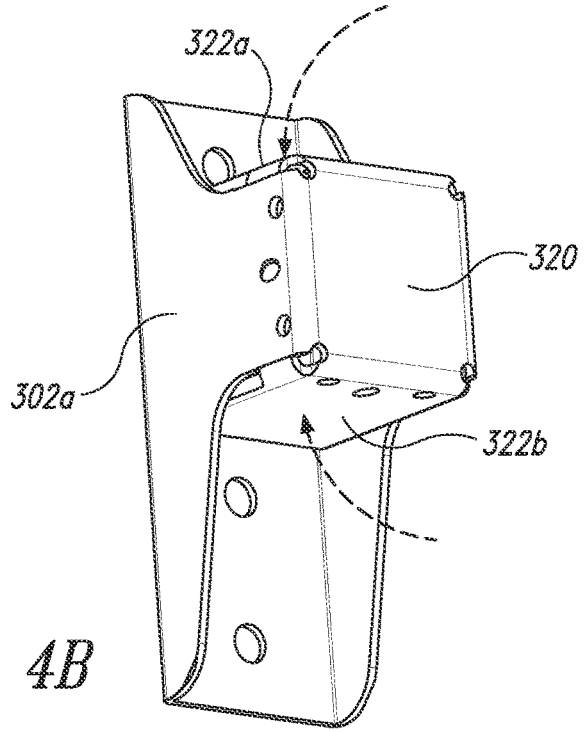

FIGS. 4A and 4B are side isometric views illustrating two stages of a process for forming a body 302*a* of the attachment device 110*a* (FIG. 2A) in accordance with embodiments of the present technology. Although FIGS. 4A and 4B show the body 302*a* for purposes of illustrating the forming process, it will be understood that the same forming process, or at least the same basic forming process, can be used to form the body 302 of the attachment device 110*b*, as well as bodies of other attachment devices configured in accordance with embodiments of the present technology. In some embodiments, the body 302*a* can formed from a workpiece 400 which can be cut or otherwise formed from a tube having a longitudinal axis 401 and a rectangular or square cross-sectional shape (e.g., a steel tube, such as a 304 stainless-steel tube, having a wall thickness of, e.g., from about 0.04 inch to about 0.12 inch, or about 0.0625 inch (16 gauge)). In other embodiments, the body 302*a* can be formed from other types of material, such as aluminum, other types of steel, extruded fiberglass, etc., having other wall thicknesses and/or other tubular or non-tubular cross-sectional shapes. In some embodiments, if the body 302*a* is to be used fora cladding component attachment device that is relatively short (e.g., the attachment device 110*a* of FIG. 2A), then the workpiece 400 can be cut from a tube having a square cross-sectional shape in which a first side wall width W1 is equal to an adjacent second side wall width W2.

For example, in some embodiments, the body 302*a* can be formed from a square tube in which both side wall widths W1 and W2 are from about 1 inch to about 3 inches, from about 1 inch to about 2 inches, or about 1.5 inches. If an even shorter body is called for, it is contemplated that embodiments of the body 302*a* can be formed from a workpiece 400 having a rectangular cross-section in which the first side wall width W1 is greater than the second side wall width W2. Conversely, if a longer body is desired (such as the body 302 of the attachment device 110*b*), then the workpiece 400 can be cut from a tube having a rectangular cross-section in which the second side wall width W2 is greater than the first side wall width W1. For example, in some embodiments, the body 302 can be formed from a workpiece 400 having a rectangular cross-section in which the first side wall width W1 is from about 1 inch to about 2.5 inches, or about 1.5 inches, and the second side wall width W2 is from about 2 inches to about 6 inches, from about 3 inches to about 5 inches, or about 4 inches.

As shown in FIG. 4A, after the workpiece 400 has been cut from a piece of tube stock, cutouts 404*a* and 404*b* can be formed in opposite side walls of the workpiece 400 (e.g., by laser cutting, saw cutting, waterjet cutting, etc.) to shape the first and second side walls 312*a* and 312*b*. Other cutting and/or drilling on the workpiece 400 can be performed to further shape the base wall 318, the end wall 320, and/or the side walls 312*a, b* and 322*a, b*. Similarly, the fastener holes 324 and 326*a, b* can also be drilled, bored, laser cut, tapped, or otherwise formed in the corresponding side walls 312*a, b* and 322*a, b* at this time.

Once the workpiece 400 has been cut or otherwise formed to the shape shown in FIG. 4A and the various holes 324 and 326*a, b* and 330*a-c* have been drilled, the portions of the tube forming the third side wall 322*a* and the fourth side wall 322*b* can be bent inwardly about corresponding bend lines 402*a* and 402*b* to create the finished body structure 302*a* as shown in FIG. 4B. As the foregoing description illustrates, in some embodiments, the body 302*a* can be formed from a single piece of raw material to produce a unitary part. Although the foregoing description illustrates one process for forming the bodies of the attachment devices 110*a* and 110*b* (FIGS. 2A and 28), this process is provided by way of example only. Accordingly, cladding component attachment devices configured in accordance with the present technology are not limited to those having bodies manufactured in the foregoing manner unless the context clearly requires otherwise. In other embodiments, for example, other methods, material stock, etc. can be used to form attachment device bodies configured in accordance with the present technology.

Returning to FIG. 3A, in addition to the body 302, the attachment device 110*b* further includes a shim plate 306 and a washer plate 304. Both the shim plate 306 and the washer plate 304 can generally have the same basic planform shape as the base wall 318 of the body 302. In the illustrated embodiment, the shim plate 306 (which, in some embodiments, can also be referred to as a base plate, spacer, thermal break, etc.) includes a plurality of fastener holes 332*a-c* (which can also be referred to as fastener apertures, openings, etc.) that are positioned in alignment with the corresponding fastener holes 330*a-c* in the body 302, and are slotted and open to one side edge of the shim plate 306. In some embodiments, the shim plate 306 can be formed from a thermally insulative material (e.g., a non-metallic material), such as a thermoplastic material (e.g., polyamide, nylon, polycaprolactam, etc.). For example, in some embodiments the shim plate 306 can be formed (e.g., injection molded) from PA6 polyamide material comprising 33% glass, or about 33% glass, and can have a nominal thickness of from about 0.08 inch to about 0.325 inch, or about 0.125 inch. In other embodiments, the shim plate 306 can be formed from other thermally insulative materials to provide a thermal break between the body 302 and the surface to which the device 110*b* is mounted (e.g., an exterior wall surface of a building). If needed, more than one shim plate 306 can be used if necessary to adjust the position of the attachment device 110*b* relative to one or more adjacent attachment devices on a building wall so that the corresponding end walls 320 of the attachment devices all lie within the same plane, or at least approximately within the same plane. Alternatively, in some embodiments, the shim plate 306 can be provided in a variety of different thicknesses T that can be selected as needed during installation to adjust the position of the attachment device 110*b* relative to one or more adjacent attachment devices on the building wall. The washer plate 304 includes a plurality of fastener holes 328*a-c* which are positioned in general alignment with the corresponding fastener holes 330*a-c* and 332*a-c* in the body 302 and the shim plate 306, respectively. The washer plate 304 can be formed from a suitable metallic material, such as a flat sheet of 304 stainless-steel having a thickness of, e.g., from 0.06 inch to about 0.12 inch, or about 0.09 inch. In some embodiments, the washer plate 304 can be omitted.

In the illustrated embodiment, the attachment device 110*b* further includes a sleeve 310 having a rectangular or square cross-sectional shape configured to fit (e.g., snugly) over the similarly shaped distal end portion of the body 302. The sleeve 310 can be formed from a suitably insulative material to serve as a thermal insulator between the body 302 and, e.g., surrounding insulation 106 (FIG. 1). For example, in some embodiments, the sleeve 310 can be extruded from a thermoplastic material, such as PA66 polyamide material comprising 25% glass, or about 25% glass. Additionally, in the illustrated embodiment, the sleeve 310 has corrugated side walls with a series of channels 346 to enhance its thermally insulating properties. In other embodiments, the sleeve 310 can have side walls with other shapes (e.g. flat shapes) and/or can be formed from other materials, and in further embodiments the sleeve 310 can be omitted.

Figure 5:
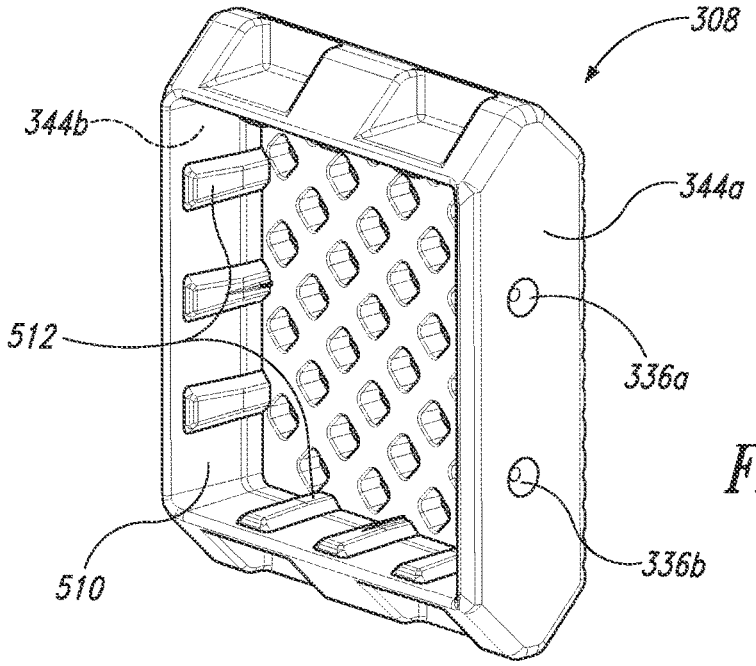
FIG. 5 is a rear isometric view of a cap of a cladding component attachment device configured in accordance with some embodiments of the present technology.

FIG. 5 is a rear isometric view of the end cap 308 configured in accordance with embodiments of the present technology. Referring to FIG. 5 together with FIG. 3A, the end cap 308 (which, in some embodiments, can also be referred to as a spacer, thermal break, and the like) can include first and second side surfaces 344*a* and 344*b*, respectively, that extend perpendicular to an end face 340, and third and fourth side surfaces 342*a* and 342*b*, respectively, that are positioned between the first and second side surfaces 344*a, b* and extend at an angle (e.g., a 45° angle) relative to the end face 340. In other embodiments, the side surfaces 342*a, b* and/or 344*a, b* can be positioned at other angles relative to the end face 340, and/or one or more of the side surfaces can be omitted. In the illustrated embodiment, each of the side surfaces 344*a, b* includes a first fastener hole 336*a* and a second fastener hole 336*b* that are configured to be positioned in general alignment with the corresponding fastener holes 326*a* and 326*b*, respectively, when the end cap 308 is positioned over the sleeve 310 on the distal end portion of the body 302. In some embodiments, the first and second fastener holes 336*a, b* can be "dimples" that extend only part of the way through the corresponding side wall of the end cap 308. In other embodiments, the first and second fastener holes 336*a, b* can be through-holes that extend all the way through the side wall of the end cap 308. Each of the third and fourth side surfaces 342*a* and 342*b* can include a corresponding fastener hole in the form of a dimple 334*a* and 334*b* (FIG. 3A), respectively, that is configured to be in general alignment with the corresponding fastener hole 324 when the end cap 308 is positioned over the sleeve 310 on the distal end portion of the body 302. Additionally, as shown in FIG. 5, the end cap 308 can include a recess or cavity 510 (e.g., a square cavity) having a plurality of protrusions or ridges 512 that extend inwardly from the side walls of the cap 308. The cavity 510 is shaped and sized so that the end cap 308 fits snugly (e.g. a friction fit) when positioned over the sleeve 310 on the distal end portion of the body 302, with the ridges 512 on the end cap 308 being slidably received in the corresponding channels 346 of the sleeve 310. As described in greater detail below, in some embodiments, the first and second side surfaces 344*a, b* can be used for attaching a cladding component (e.g., a girt, rail, accessory, etc.) having parallel side walls to the attachment devices 110, 120 described herein, and the third and fourth side surfaces 342*a, b* can be used for attaching a cladding component having side walls that are angled relative to each other to the attachment devices 110, 120.

In some embodiments, the end cap 308 can be formed from a thermally insulative (or at least partially thermally insulative) non-metallic material, such as a thermoplastic material (e.g., polyamide, nylon, polycaprolactam, etc.). For example, in some embodiments, the end cap 308 can be formed (e.g., injection molded) from PA6 polyamide material comprising 33% glass, or about 33% glass. In some embodiments, the end cap 308 can have a relatively low thermal conductivity that is less than the thermal conductivity of the body 302. For example, in some embodiments, the end cap 308 can have a thermal conductivity of from about 0.15 W/(m·K) to about 0.5 W/(m·K), or about 0.23 W/(m·K).

Turning next to FIG. 3B, to at least partially assemble the attachment device 110*b*, the washer plate 304 is inserted against the interior surface of the body base wall 318 between the base wall 318 and the free edges of the third and fourth side walls 322*a* and 322*b* furthest away from the end wall 320. The sleeve 310 can also be positioned over the distal end portion of the body 302 at this time. In some embodiments, this level of subassembly can be carried out prior to shipment of the devices 110*b* to the worksite, with subsequent assembly occurring at the worksite during installation. Turning next to FIG. 3C, prior to installation at the worksite, the shim plate 306 can be positioned against the backside of the base wall 318 and the fasteners 314*a, b* can be inserted through the fastener holes 328*a, b*, 330*a, b* and 332*a, b* in the washer plate 304, the base wall 318, and the shim plate 306, respectively, and threadably engaged with the building wall 104 (FIG. 1). If it is determined that the distal end portion of the body 302 needs to be positioned further away from the building wall, then an additional shim plate 306 can be inserted behind the body 302 by means of the slotted fastener holes 332*a, b* before the fasteners 314*a, b* are fully torqued. Alternatively, the existing shim plate 306 can be slipped out from behind the body 302 (via the slotted holes 332*a, b*) before the fasteners 314*a, b* are fully torqued and a new, thicker (or thinner, if it is desired to position the distal end portion of the body 302 closer to the building wall) shim plate 306 can be inserted behind the body 302 to adjust the position of the end wall 320 as needed. If more than the two fasteners 314*a, b* are needed for loading requirements, then an additional fastener 314 (not shown) can be installed through the fastener holes 328*c*, 330*c*, and 332*c* in the washer plate 304, the base wall 318, and the shim plate 306, respectively. Once the attachment device 110*b* has been correctly positioned, the fasteners 314*a, b* can be fully torqued to fixedly attach the attachment device 110*b* to the building wall or other substructure.

Turning next to FIG. 3D, the cladding component attachment device 110*b* can be further assembled by inserting the distal end portion of the body 302 together with the distal end portion of the sleeve 310 into the cavity 510 (FIG. 5) in the end cap 308 to mount the end cap 308 to the body 302. As described in greater detail below, this step would normally occur after the insulation 106 has been installed on the building wall 104 (FIG. 1). In one aspect of this embodiment, it will be appreciated that the square cross-sectional shape of the distal end portion of the body 302 and the complimentary square shape of the cavity 510 in the end cap 308 enables the end cap 308 to be attached to the distal end portion of body 302 in at least two different orientations. That is, in the orientation shown in FIG. 3D, or a second orientation rotated 90 degrees (clockwise or counterclockwise) from the orientation of FIG. 3D in which the side surfaces 342*a, b* are positioned adjacent to the first and second side walls 312*a, b* (FIG. 3A), respectively, and the side surfaces 344*a, b* are positioned adjacent to the fourth and third side walls 322*b*, a (FIG. 3A), respectively. As described in greater detail below, this enables the end cap 308 to be positioned on the body 302 in whichever of the two orientations is needed to best accommodate the cross-sectional shape (e.g., parallel side walls or angled side walls) and/or the orientation (e.g., vertical or horizontal) of the corresponding cladding component (e.g., girt, rail, accessory, etc.) that is subsequently mounted to the attachment device 110*b*.

Referring to FIG. 3D, by way of example only, in some embodiments, the cladding component attachment device 110*b* can have a height H of from about 2 inches to about 8 inches, from about 3 inches to about 6 inches, or about 4 inches; a width W of from about 0.75 inch to about 3 inches, from about 1 inch to about 2 inches, or about 1.3 inches; and a length L of from about 3 inches to about 6 inches, from about 3.5 inches to about 5 inches, or about 4 inches. By way of comparison, in some embodiments, the attachment device 110*a* (FIG. 2A) can have a height H and a width W that are the same as, or are at least approximately the same as, the height H and the width W of the attachment device 110*b*, but the attachment device 110*a* can have a shorter length L of from about 1 inch to about 3 inches, or about 2 inches. As will be appreciated by those of ordinary skill in the art, the foregoing dimensions are provided by way of example only and are representative of various embodiments of the attachment devices 110*a, b* described herein. Accordingly, in other embodiments, attachment devices configured in accordance with the present disclosure can have other dimensions.

Figure 6A:
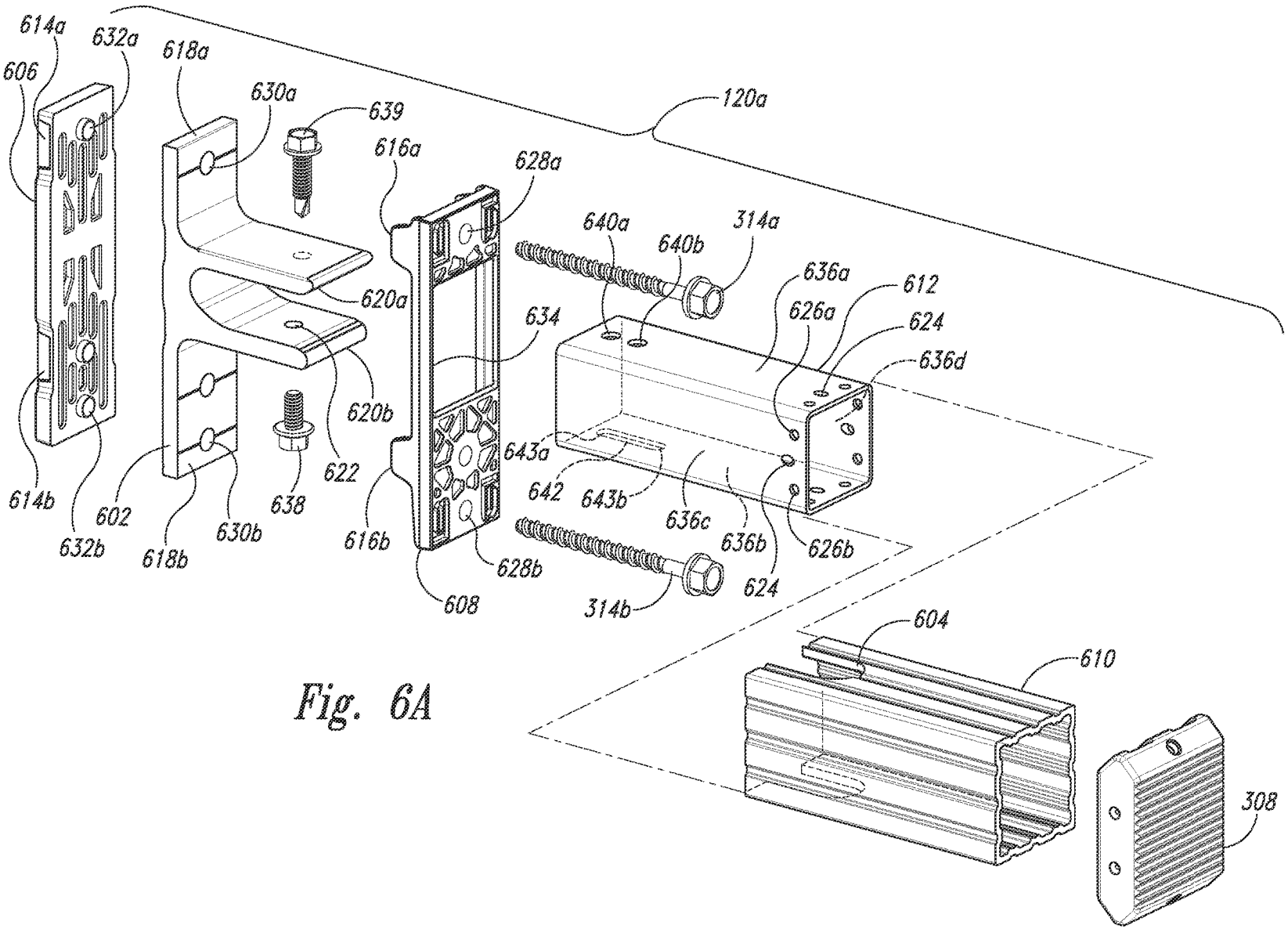
FIGS. 6A and 6B are partially exploded isometric views of a cladding component attachment device configured in accordance with other embodiments of the present technology.
Figure 6B:
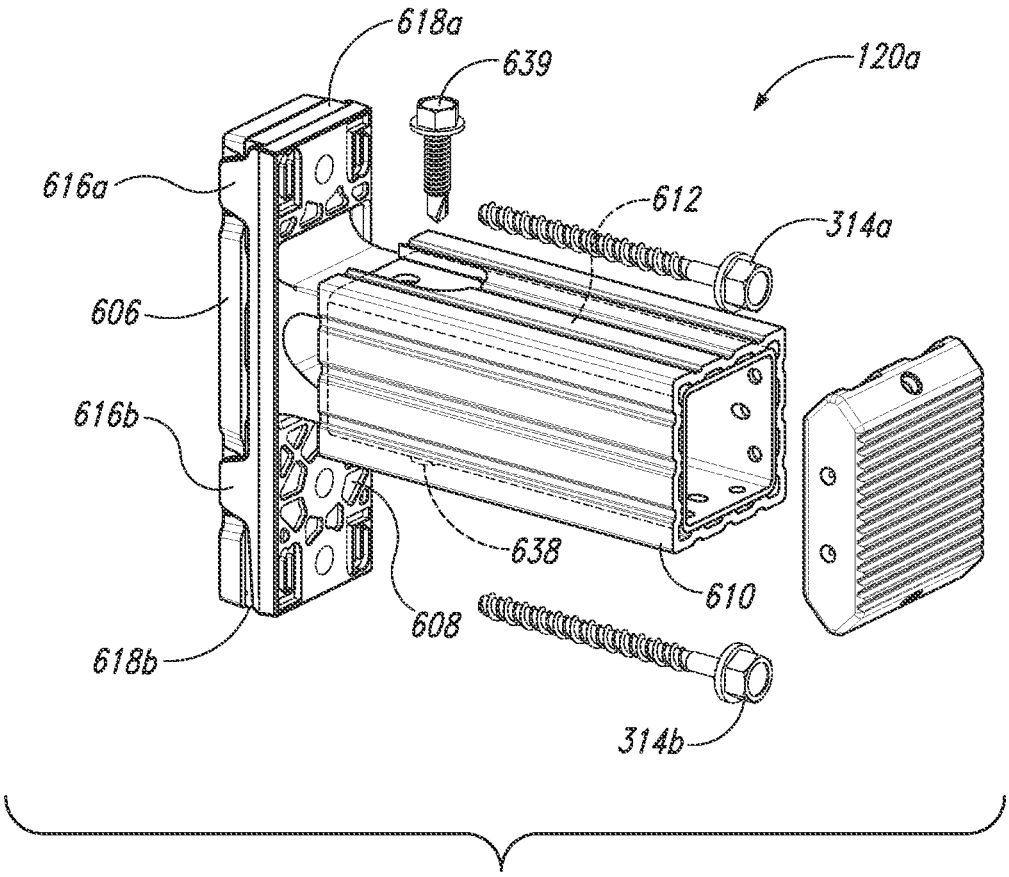
Figure 6C:
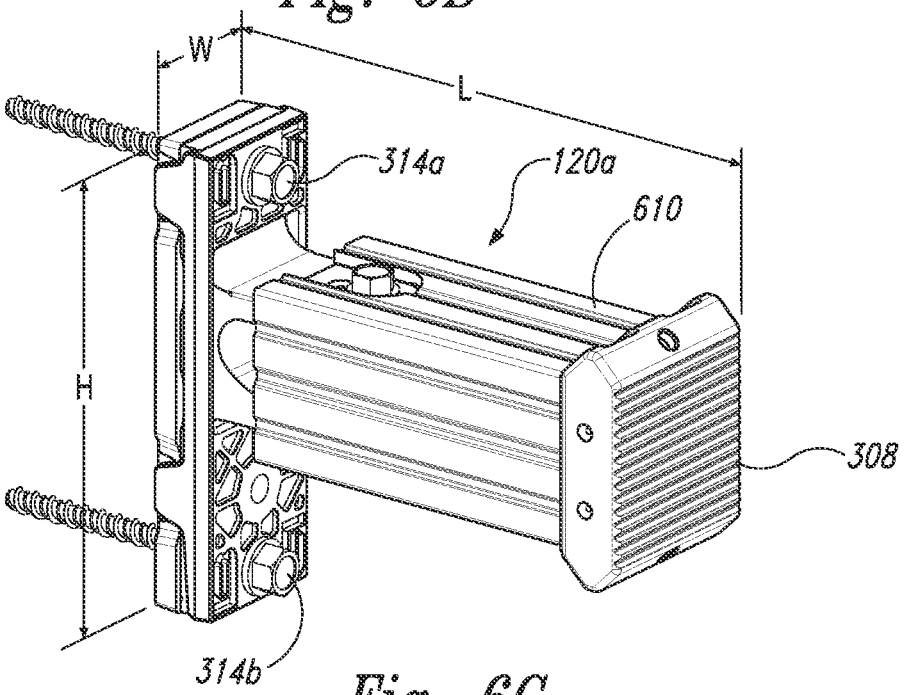
FIG. 6C is an assembled isometric view of the cladding component attachment device of FIGS. 6A and 6B.

FIGS. 6A and 6B are partially exploded isometric views of the cladding component attachment device 120*a* configured in accordance with embodiments of the present technology, and FIG. 6C is an assembled isometric view of the cladding component attachment device 120*a*. Referring first to FIG. 6A, in the illustrated embodiment, the attachment device 120*a* includes a base 602 and a support arm 612. In one aspect of this embodiment, the base 602 includes a first or upper base flange 618*a* and a second or lower base flange 618*b*, each having a corresponding fastener hole 630*a* and 630*b*, respectively, which are configured to receive corresponding fasteners 314*a* and 314*b* to fixedly attach the base 602 to a building wall or other substructure (e.g., the building wall 104; FIG. 1). Additionally, in some embodiments, the base flange 618*b* or both base flanges 618*a, b* can include additional fastener holes if additional fasteners are required to carry the loads imposed by the cladding component attached to the device 120*a* or to provide other fastener installation options. In addition to the base flanges 618*a, b*, the base 602 further includes a first or upper support flange 620*a* and a second or lower support flange 620*b* extending outwardly (e.g., horizontally) from the base flanges 618*a, b*. In the illustrated embodiment, the lower support flange 620*b* includes a fastener hole 622 (e.g., a threaded fastener hole) configured to receive and threadably engage a corresponding fastener 638 (e.g., a threaded fastener or, if the hole 622 is untapped, a self-tapping fastener, such as a self-tapping stainless-steel fastener, having a diameter of from about 0.19 inch to about 0.50 inch, or about 0.25 inch). Additionally, in some embodiments, the upper support flange 620*a* does not have a preformed fastener hole so that a fastener 639 (e.g., a self-drilling, self-tapping fastener, such as a self-drilling, self-tapping stainless steel fastener having a diameter of from about 0.19 inch to about 0.50 inch, or about 0.25 inch) can be threadably inserted through the support flange 620*a* in a desired location during final installation of the support arm 612, as described in more detail below. In some embodiments, the base 602 can be formed from an extrusion that is cut transversely to produce the base 602 with a desired width. For example, in some embodiments, the base 602 can be formed from an aluminum extrusion, such as a 6063-T5 aluminum alloy extrusion. In other embodiments, the base 602 can be formed from other suitable materials including, for example, other aluminums, steels, fiberglass, composite materials, etc., using other suitable manufacturing processes including, for example, machining, welding, casting, molding, etc.

In some embodiments, the support arm 612 is a tubular member having a rectangular (e.g., a square) cross-sectional shape defined by four side walls 636*a-d*. For example, in some embodiments, the support arm 612 can have a square cross-section in which each side wall 636*a-d* has a width of from about 1 inch to about 3 inches, from about 1 inch to about 2 inches, or about 1.5 inches. In other embodiments, the support arm 612 can have a rectangular or square cross-section of other sizes. The side walls 636*a-d* form an interior passage through the support arm 612 that is configured to receive the support flanges 620*a, b* so that the outer surface of the first support flange 620*a* and the outer surface of the second support flange 620*b* fit against (or at least approximately against) the interior surfaces of the side walls 636*a* and 636*b*, respectively. In the illustrated embodiment, the proximal end portion of the first side wall 636*a* includes first and second fastener holes 640*a* and 640*b*, respectively, and the proximal end portion of the second side wall 636*b* includes an elongated hole or slot 642. In some embodiments, the centerlines of the fastener holes 640*a* and 640*b* can be spaced apart by a distance of, e.g., from about 0.25 inch to about 1.5 inches, or about 0.5 inch, and the slot 642 can have a length of from about 0.5 inch to about 2 inches, or about 1.25 inches between a first end 643*a* and a second end 643*b*. In some embodiments, the distal end portions of each side wall 636*a-d* of the support arm 612 includes a pattern of fastener holes that is the same as, or is at least generally similar to, the corresponding pattern of fastener holes 324, 326*a* and 326*b* described above with reference to FIG. 3A. For example, each side wall 636*a-d* can include first and second fastener holes 626*a* and 626*b* in the same configuration (e.g., the same size, orientation, spacing) as the corresponding fastener holes 326*a, b* described above with reference to FIG. 3A, and a third fastener hole 624 positioned therebetween in the same configuration as the corresponding fastener hole 324 described above with reference to FIG. 3A.

In some embodiments, use of a square tube for the support arm 612 has the benefits of providing a shape with multiple flat surfaces that components (e.g., cladding components) can be fastened to; providing structural strength in multiple different loading directions; and providing the ability to accommodate a wide range of exterior insulation thicknesses by simply varying the length of the tube. The support arm 612 can be formed from various types of suitable materials using various methods of manufacture. For example, in some embodiments, the support arm 612 can be formed from a hollow member (e.g., a tube) that is formed from a suitable metal, such as steel (e.g., a 304 stainless-steel tube having a wall thickness of, e.g., from about 0.04 inch to about 0.12 inch, or about 0.0625 inch (i.e., 16 gauge)). In other embodiments, the support arm 612 can be formed from other suitable materials including, for example, aluminum tubes, fiberglass tubes, composite tubes, etc. Additionally, although the support arm 612 in the illustrated embodiment is depicted as a tubular member having a square cross-sectional shape, in other embodiments, the support arm 612 can have other cross-sectional shapes including, for example, non-square rectangular shapes, other polygonal shapes, circular cross-sectional shapes, etc. In yet further embodiments, it is contemplated that the support arm 612 could be a non-tubular member having a cross-sectional shape that is at least partially open, such as an open channel (e.g., C-channel) shape, etc.

In the illustrated embodiment, the attachment device 120*a* further includes a first base plate 606 and a second base plate 608. The first base plate 606 can include a first fastener hole 632*a* and a second fastener hole 632*b*. Similarly, the second base plate 608 can also include a first fastener hole 628*a* and a second fastener hole 628*b*. In some embodiments, the first base plate 606 and the second base plate 608 can further include additional fastener holes as needed to accommodate additional fasteners if needed to carry higher loads, and/or to provide optional fastener positions if needed for a particular installation. In addition to the fastener holes 628*a, b*, the second base plate 608 further includes an aperture 634 (e.g., a rectangular or square-shaped aperture) configured to enable the support flanges 620*a, b* of the base 602 to extend therethrough.

Figure 7:
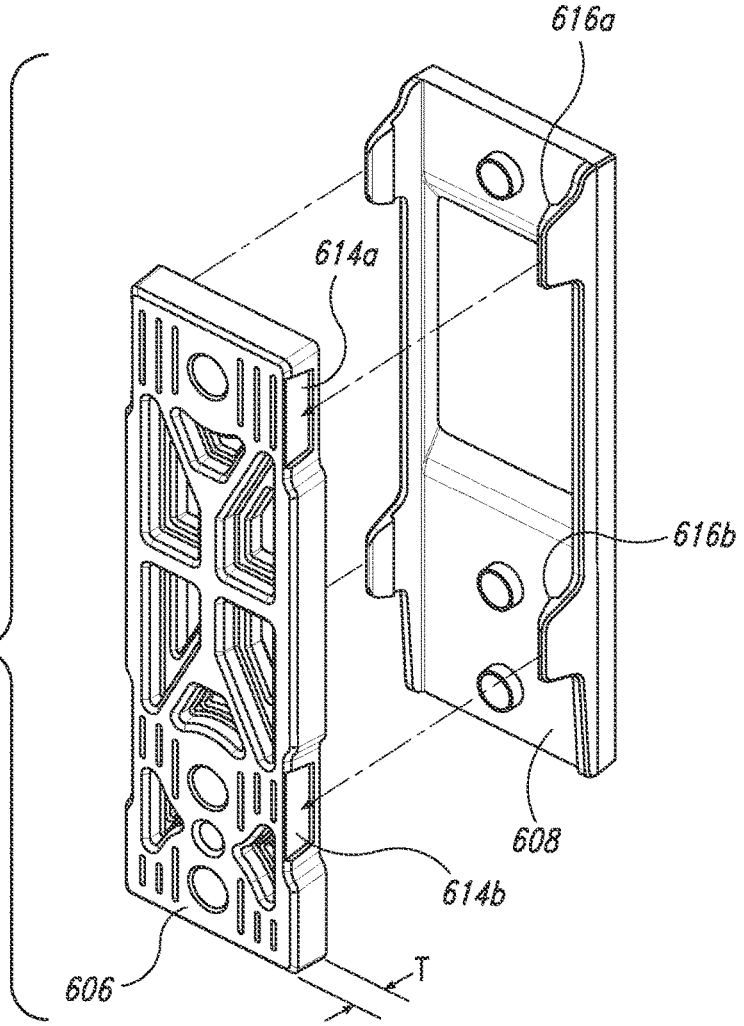
FIG. 7 is a rear isometric view of first and second base plates of the cladding component attachment device of FIGS. 6A-6C, configured in accordance with some embodiments of the present technology.

Referring to FIG. 7, the second base plate 608 also includes first and second projections or tabs 616*a, b* on each side thereof, which are configured to be received by corresponding recesses 614*a, b*, respectively, formed in the corresponding side portions of the first base plate 606 to couple the two parts together during assembly of the attachment device 120*a* as described in more detail below. In some embodiments, the first base plate 606 and the second base plate 608 can be formed from insulative materials that provide a thermal break between the base 602 and the adjacent wall of the building to which the attachment device 120*a* is fixedly attached. Accordingly, in such embodiments, the first base plate 606 and the second base plate 608 can be referred to collectively as a "two-piece thermal break." For example, in some embodiments, the first and second base plates 606 and 608 can be formed from a thermoplastic material, such as an injection-molded PA6 material having 33% glass, or about 33% glass. In other embodiments, the first and second base plates 606 and 608 can be formed from other materials, such as other materials that provide relatively good insulative properties. Additionally, in some embodiments, the first base plate 606 can be provided in a variety of thicknesses T such that an appropriate thickness can be selected to shim the position of the base 602 relative to the adjoining wall as necessary to bring the distal end caps 308 of adjacent attachment devices 120*a* into plane with each other.

Returning to FIG. 6A, in addition to the foregoing components, the attachment device 120*a* can further include the end cap 308 as described above with reference to, e.g., FIGS. 3A and 5, and a sleeve 610. The sleeve 610 can have an overall length that is the same as, or at least approximately the same as, the length of the support arm 612, and can be the same in structure and function, or at least generally similar in structure and function, to the sleeve 310 described above with reference to FIG. 3A. In some embodiments, the sleeve 610 provides a thermal break that enhances the thermal efficiency of the attachment device 120*a*, and can include two cutouts 604 on the proximal end portion of thereof to accommodate the fasteners 638 and 639.

Referring next to FIG. 6A together with FIG. 6B, the attachment device 120*a* can be assembled in one embodiment as follows: First, the first base plate 606 can be positioned against the back side of the base 602 and the second base plate 608 can be positioned over the base 602 with the support flanges 620*a, b* extending through the aperture 634. As the base flanges 618*a, b* of the base 602 are sandwiched between the first base plate 606 and the second base plate 608, the tabs 616*a, b* on the second base plate 608 snap into place in the corresponding recesses 614*a, b* in the first base plate 606, as shown in FIG. 6B. Next, the proximal end portion of the support arm 612 can be positioned over the support flanges 620*a, b* of the base 602 so that the support flanges 620*a, b* extend into the proximal end portion of the support arm 612. The fastener 638 is then inserted through the slot 642 and threadably engaged with the hole 622 in the lower support flange 620*b* but not fully torqued. Next, the sleeve 610 can be installed over the distal end portion of the support arm 612.

Referring next to FIGS. 6A-6C together, to install the attachment device 120 to a building wall or other substructure (not shown), the fasteners 314*a, b* can be inserted through the corresponding fastener holes 628*a, b*, 630*a, b* and 632*a, b*, (FIG. 6A) respectively, and threadably engaged with the building wall structure and fully torqued. Next, the overall length of the attachment device 120*a* can be adjusted (e.g., "levelled") if needed to account for the building wall or other substructure not being sufficiently flat or plumb. In this regard, it will be noted that the slot 642 in the proximal end portion of the support arm 612 provides a telescoping adjustability feature, whereby the user can adjust the overall length of the attachment device 120*a* by a distance equivalent to the length of the slot 642 minus the diameter of the fastener 638. More specifically, if the slot 642 has an overall length of 1.25 inches and the fastener 638 has a diameter of 0.25 inch, then the slot 642 will provide 1 inch of adjustment. For example, if it is desired to make the attachment device 120*a* longer, the user can move the support arm 612 outwardly relative to the base 602 up to the point that the fastener 638 contacts the first end 643*a* of the slot 642 (FIG. 6A). Conversely, if it is desired to make the attachment device 120*a* shorter, the installer can move the support arm 612 inwardly relative to the base 602 up to the point that the fastener 638 contacts the second end 643*b* of the slot 642 (FIG. 6A). Once the length has been properly adjusted, the fastener 638 can be fully torqued and the fastener 639 can be inserted through either the first hole 640*a* or the second hole 640*b* in the support arm 612 and threadably engaged with the upper support flange 620*a* (by, e.g., self-drilling and self-tapping a corresponding hole in the support flange 620*a*). It should be noted that, in some embodiments, the support arm 612 includes the two fastener holes 640*a* and 640*b* in case use of one of the two holes causes the fastener 639 to contact or otherwise interfere with the fastener 638 during installation of the fastener 639. If that should occur during installation of the fastener 639 in one of the two holes 640*a* or 640*b*, the user can simply install the fastener 639 in the other of the two holes 640*a* or 640*b* to avoid the interference. In some embodiments, the adjustability feature described above can be achieved by other methods, and in other embodiments, the adjustability feature can be omitted. For example, in some embodiments, the proximal end portions of the first and second side walls 636*a* and 636*b* of the support arm 612 can each include a single fastener hole configured to receive a corresponding fastener for attaching the support arm 612 to the support flanges 620*a* and 620*b*. After the support arm 612 has been attached to the base 602, the end cap 308 can be mounted on (e.g., press-fit on) the distal end portion of the sleeve 610 and the support arm 612 (in the desired orientation) as described above with reference to FIG. 3C.

With reference to FIG. 6C, by way of example, the base of the attachment device 120*a* can have a height H of from about 2 inches to about 15 inches, from about 3 inches to about 10 inches, or about 4.8 inches; and a width W of from about 0.75 inch to about 4 inches, from about 1 inch to about 3 inches, or about 1.5 inches. It will be appreciated that the length of the support arm 612 can be selected (e.g., custom fit) to provide the attachment device 120*a* with virtually any desired overall length L to accommodate a wide range of installation applications. For example, in some embodiments, the support arm 612 can be sized to provide the attachment device 120*a* with an overall length L of from about 3 inches to about 24 inches or more, from about 3 inches to about 18 inches, from about 3 inches to about 12 inches, from about 4 inches to about 8 inches, or about 6 inches. Accordingly, embodiments of the attachment device 120*a* can be made to essentially any length that may be required for a particular application depending on, for example, the thickness of insulation applied to the exterior of the building wall. Additionally, the slot 642 enables the length of the attachment device 120*a* to be "fine-tuned" as described above to provide yet further adjustability of the overall length of the device 120*a* if needed.

Figure 8A:
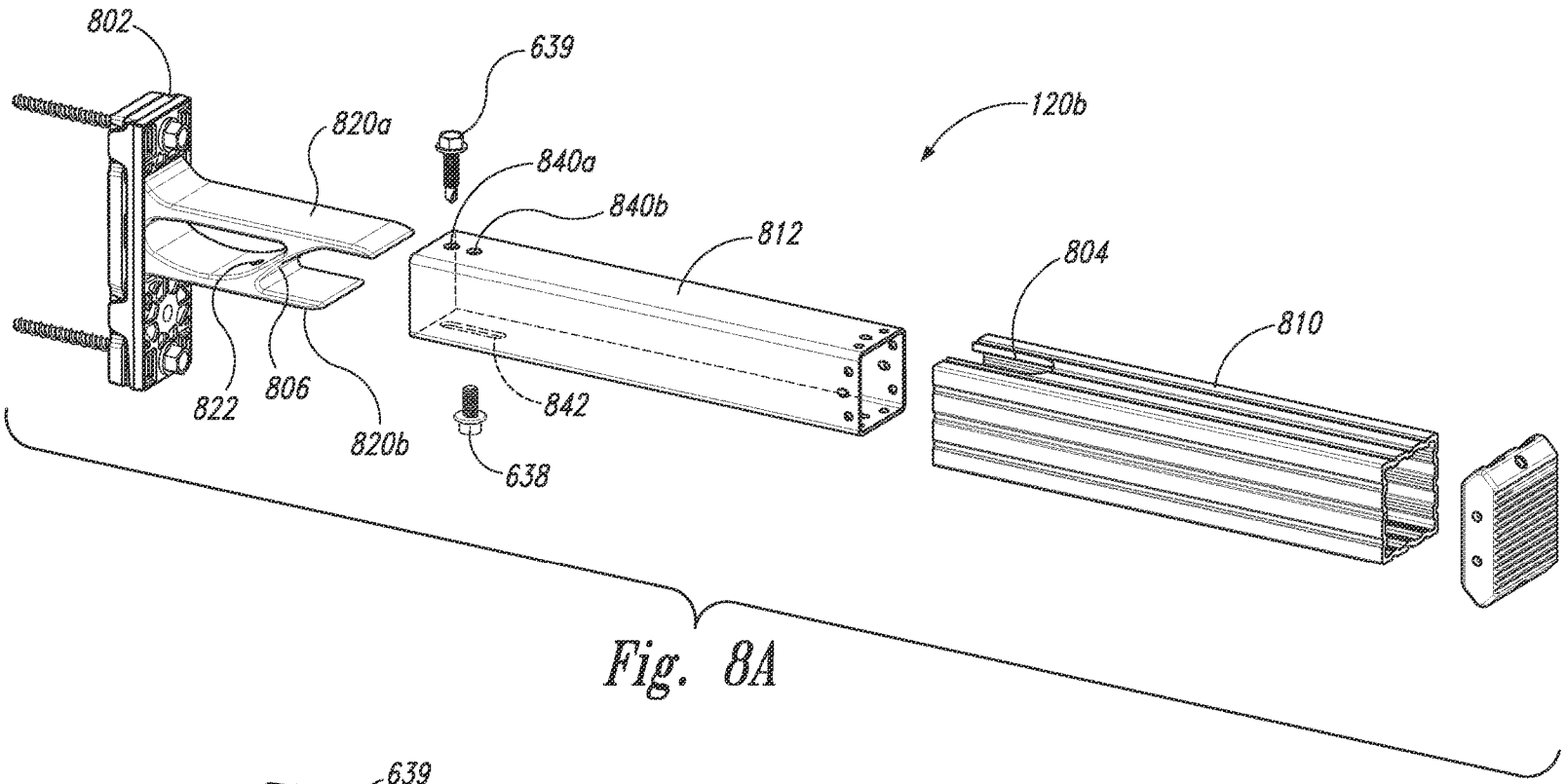
FIGS. 8A and 8B are partially exploded isometric and assembled isometric views, respectively, of a cladding component attachment device configured in accordance with further embodiments of the present technology.
Figure 8B:
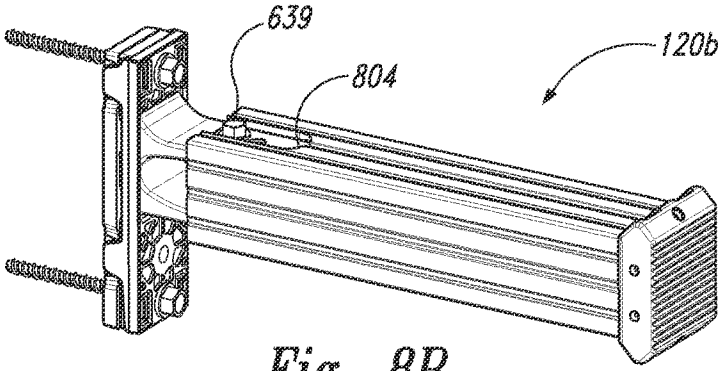

FIGS. 8A and 8B are partially exploded isometric, and assembled isometric views, respectively, of the cladding component attachment device 120*b* configured in accordance with embodiments of the present technology. The attachment device 120*b* can be at least generally similar in structure and function to the attachment device 120*a* described in detail above. For example, in some embodiments, the attachment device 120*b* can include a support arm 812 that is essentially the same in structure and function as the support arm 612 but longer. For example, in some embodiments the support arm 812 can have a length of from about 6 inches to about 36 inches, from about 8 inches to about 24 inches, or about 14 inches. In one aspect of the illustrated embodiment, however, the attachment device 120*b* includes a base member 802 that includes a reinforcing web 806 extending between an upper support flange 820*a* and a lower support flange 820*b*. Even with the addition of the web 806, the base member 802 can still be formed with the materials and extrusion techniques described above with reference to the base 602. The additional strength added by the web 806 may be necessitated by the additional loads imposed by the longer support arm 812. The attachment device 120*b* can also include a sleeve 810 that is generally the same as the sleeve 610 described above with reference to the attachment device 120*a* but longer to accommodate the longer support arm 812. Accordingly, like the sleeve 610 the sleeve 810 can include two cutouts 804 on the proximal end portion of the sleeve 810 to accommodate the fasteners 638 and 639 as shown in FIG. 8B.

Figure 9A:
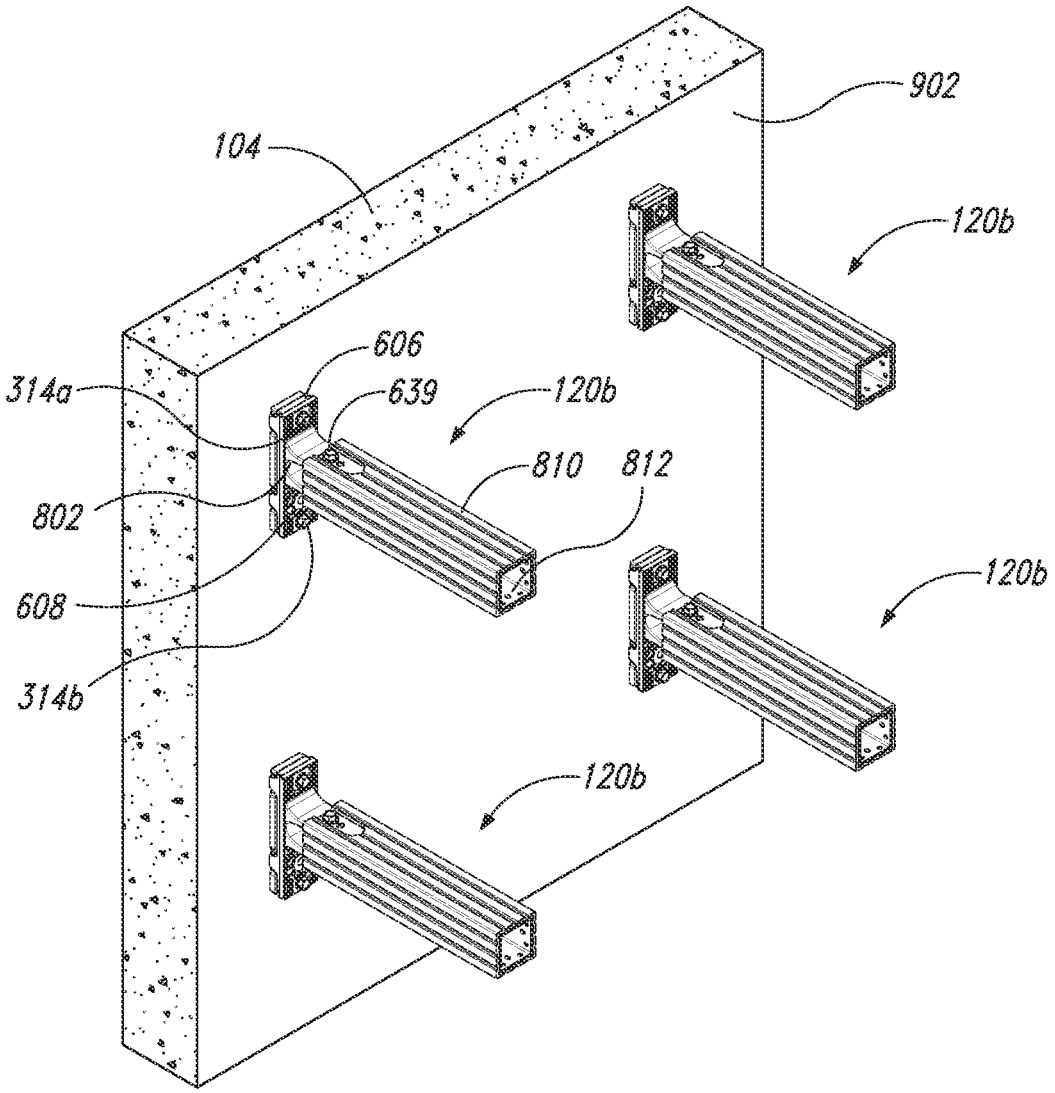
FIGS. 9A-9C are a series of isometric views illustrating various stages of installing a plurality of cladding component attachment devices and thermal insulation on an exterior wall of a building, in accordance with some embodiments of the present technology.
Figure 9B:
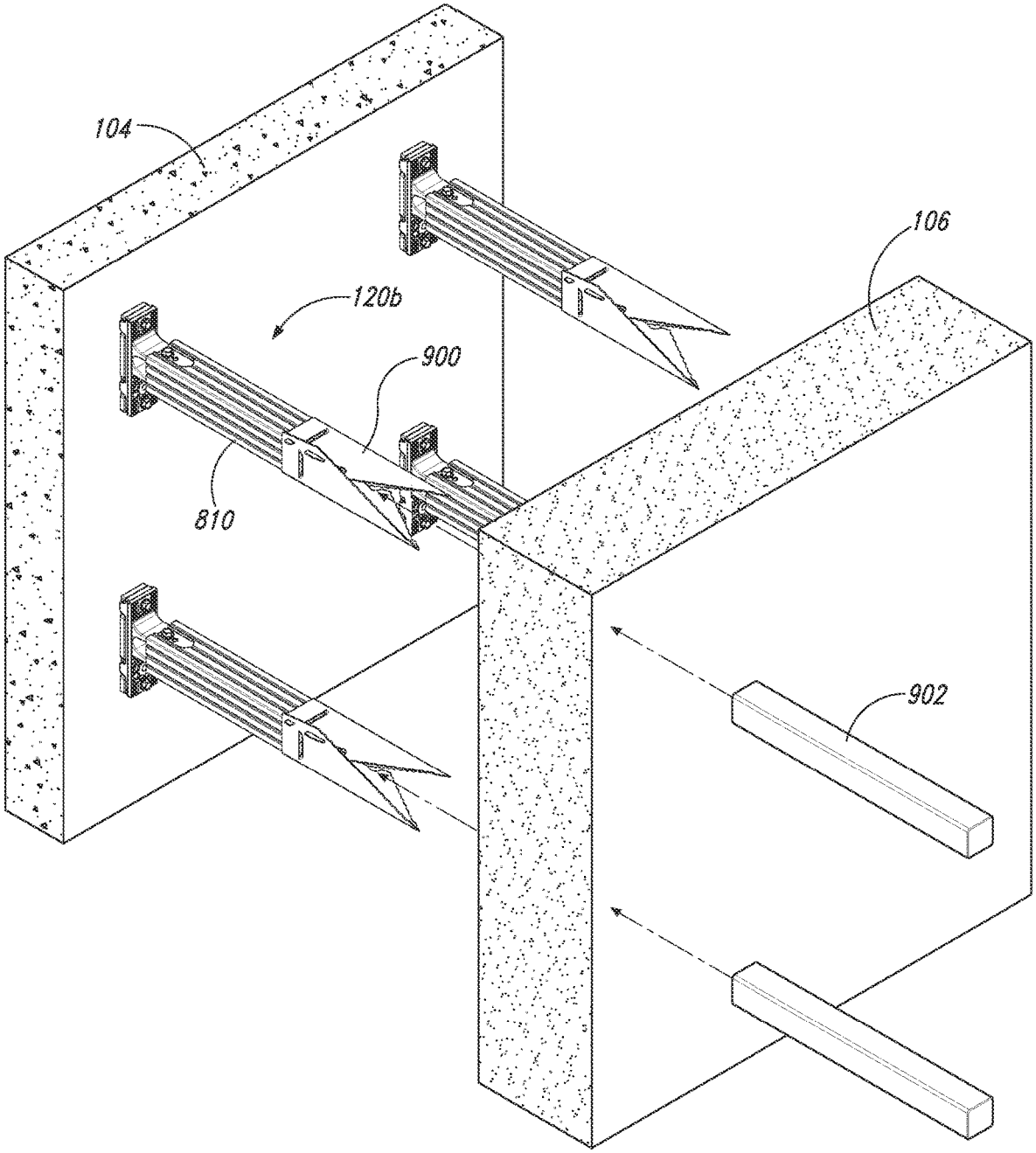
Figure 9C:
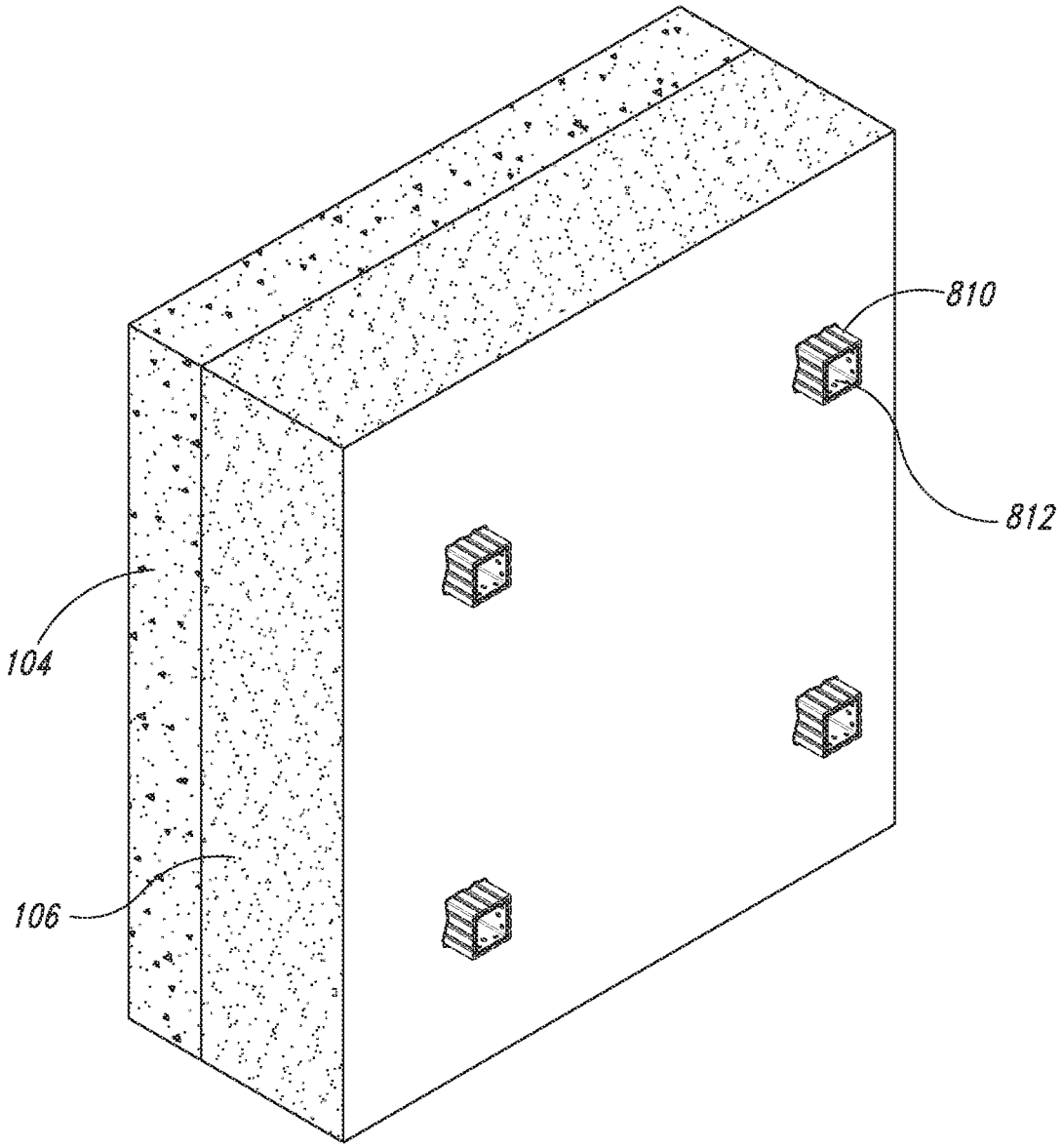

FIGS. 9A-9C are a series of isometric views illustrating various stages of a method for installing a plurality of the attachment devices 120*b* on an exterior wall 104 of a building, and for installing insulation 106 over the attachment devices 120*b*, in accordance with embodiments of the present technology. Although FIGS. 9A-9C and the associated description refer to the attachment device 120*b* for purposes of illustration, the methods of device installation described herein also apply in pertinent part to the attachment devices 120*a*, 110*a*, and 110*b*. Referring first to FIG. 9A, the desired locations of the attachment devices 120*b* can be laid out and marked on an exterior surface 902 of the wall 104 in a suitable arrangement to accommodate the desired arrangement of cladding components (e.g., girts) and the expected load conditions. Prior to installation, the attachment devices 120*b* can be fully assembled except that the end cap 308 is not installed, the fastener 639 is not installed, and the fastener 638 is installed through the slot 842 and into the hole 822 in the base 802 (FIG. 8A) but not fully torqued. At each of the marked locations, the fasteners 314*a* and 314*b* are inserted through the corresponding fastener holes in the second base plate 608, the base 802, and the first base plate 606 and threaded into the wall 104 and fully torqued. At this point, it may be necessary to "lever" adjacent attachment devices 120*b* so that their distal end portions lie in the same vertical plane, or at least approximately the same vertical plane, and so that the final installation of, e.g., cladding, also lies in a relatively flat plane. In some embodiments, the devices can be leveled as described above by moving the support arm 812 in or out as needed relative to the base 802 (within the limits afforded by the slot 842), and then fully torqueing the fastener 638 to hold the support arm 812 in place while the fastener 639 is inserted through one of the two holes 840*a* or 840*b* and threadably engaged with the upper support flange 820*a* of the base 802 (FIG. 8A). It will be appreciated that the steps for attaching the support arms 812 described above do not apply to the attachment devices 110*a, b* (FIGS. 3A-3D), but that the attachment devices 110*a, b* can be attached to the wall 104 and leveled with use of the shim plates 306 as described above with reference to FIG. 3C.

Figure 10A:
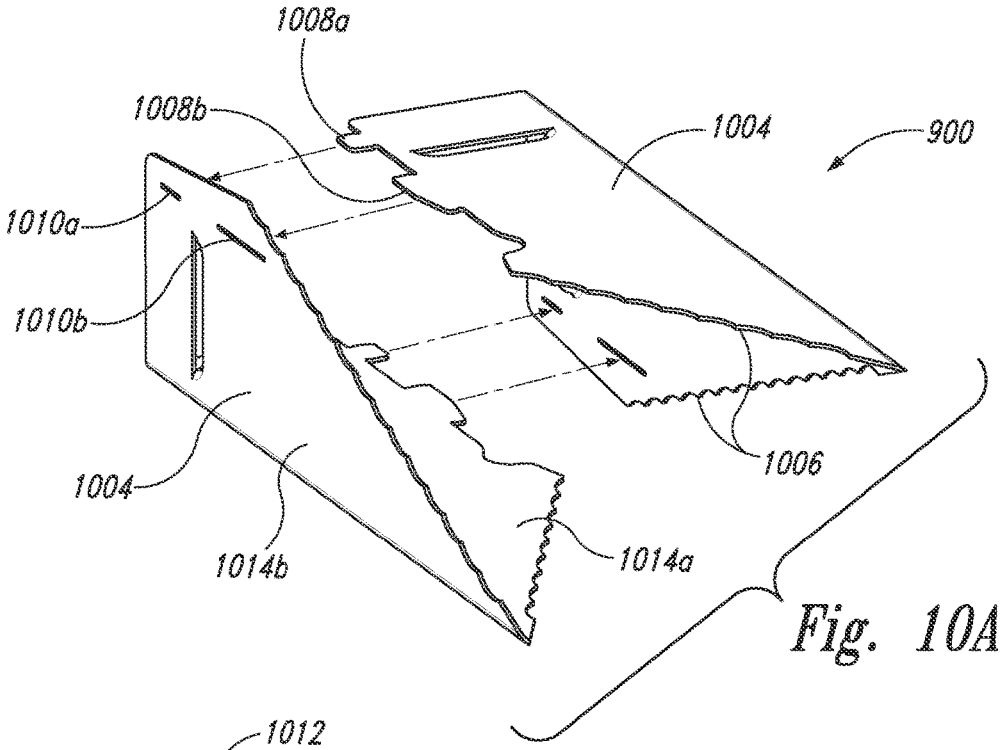
FIGS. 10A-10C are exploded isometric, assembled isometric, and end views, respectively, of an insulation piercing tool configured in accordance with some embodiments of the present technology.
Figure 10B:
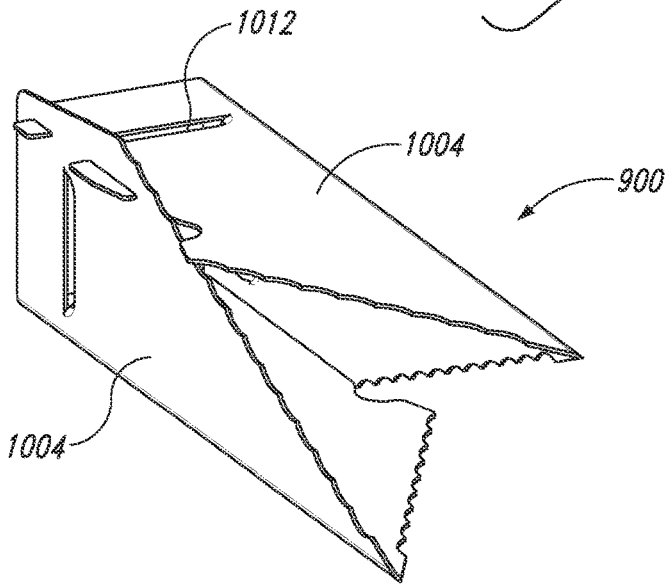
Figure 10C:
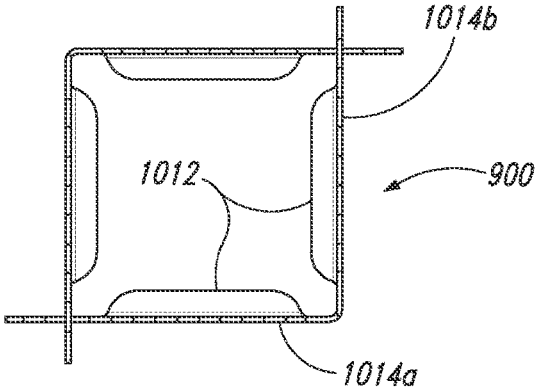

Referring next to FIG. 9B, in one aspect of the present technology, a piercing tool 900 configured in accordance with the present technology can be temporarily attached to the distal end portion of each of the support arms 812 to facilitate the installation of insulation over/around the attachment devices 120*b*. More specifically, referring to FIGS. 10A-10C, these Figures are an exploded isometric view, an assembled isometric view, and an end view of the piercing tool 900 configured in accordance with an embodiment of the present technology. Referring to FIGS. 10A and 10B together, in some embodiments, the piercing tool 900 can be formed from two identical, or at least approximately identical, sheet metal parts 1004, that each have a first panel 1014*a* and a second panel 1014*b* which are formed at a 90° angle and include serrated edges 1006 and a pointed apex on one end portion thereof. Additionally, each half 1004 of the piercing tool 900 can include one or more tabs 1008*a* and 1008*b* extending from an edge of the first panel 1014*a*, and corresponding slots 1010*a* and 1010*b* in an edge portion of the adjacent second panel 1014*b*. As shown in FIG. 10B, the piercing tool of this embodiment can be assembled by inserting the tabs 1008*a, b* into the corresponding slots 1010*a, b* and then bending the tabs over, tack welding the tabs to the adjacent panel 1014*b*, and/or otherwise joining the adjacent panels 1014*a, b* together at the connections to form the piercing tool 900 having a generally square cross-sectional shape, as shown in FIG. 10C. More specifically, the panels 1014*a, b* form side walls of the piercing tool 900 that form a square cross-sectional shaped opening that is configured to fit snugly over the distal end portion of the sleeve 810 as shown in FIG. 9B. If the attachment devices 110*a* or 110*b* are being used instead of the attachment devices 120*a* or 120*b*, the piercing tool 900 can be positioned over the distal end portion of the sleeve 310 of the devices 110*a, b* in a similar manner. If the attachment devices 110*a, b* and 120*a,b* are being used without a sleeve, the piercing tool 900 can be configured to fit securely over the distal end portion of, e.g., the body 302 or the support arm 612, 812, without a sleeve therebetween. As shown in FIG. 10C, each panel 1014*a, b* of the piercing tool 900 further can include a shoulder 1012 or similar feature that extends inwardly to abut the distal end portion of the sleeve 810 (and/or the support arm 812) and prevent the piercing tool 900 from moving too far inwardly on the support arm in use. The method described above for forming the piercing tool 900 is but one example of a suitable method for forming a piercing tool configured in accordance with the present technology. In other embodiments, other forming methods (e.g., casting, machining, etc.) and/or other materials (e.g., composites, etc.) can be used to form a piercing tool having, e.g., sidewalls that define a square cross-sectional shape that is configured to fit snugly over the distal end portion of the sleeve 810 and have cutting edges for piercing insulation.

Returning to FIG. 9B, once the piercing tools 900 have been positioned over the distal end portions of the individual support arms 812, insulation 106 (e.g., a mineral insulation material such as, for example, ROCKWOOL®) can be installed around the attachment devices 120*b* by use of a suitable tool 902 in the form of a pushrod having a square cross-section configured to fit within the openings (e.g., the square openings) in the distal end portions of piercing tools 900 and/or the support arms 812. More specifically, a sheet or other piece of insulation 106 can be positioned against the sharp edges 1006 of the piercing tools 900 (FIG. 10A) in a desired location. Next, the pushrod 902 can be used to push the insulation 106 over one of the attachment devices 120*b* by aligning the pushrod 902 with the longitudinal axis of the corresponding support arm 812, and pushing on the insulation 106 with the distal end of the pushrod 902 until the distal end of the pushrod 902 passes through the opening in the piercing tool 900. As this happens, the distal end of the pushrod 902 pushes a portion (e.g., a square portion) of the insulation 106 in front of the pushrod 902 into the piercing tool 900, thereby cutting a square hole in the insulation 106 so that the insulation 106 can slide over the sleeve 810 of the attachment device 120*b*. This process can be repeated at each of the attachment devices 120*b*. Once this is done, the piercing tools 900 can be removed and the insulated wall 104 will be ready for installation of the end caps 308 on the distal end portions of the support arms 812 as shown in FIG. 9C.

In some embodiments, using the piercing tool 900 to form the rectangular (e.g., square) opening in the insulation 106 creates a tighter fit between the insulation and the attachment device 120*a* than might otherwise be achieved, thereby reducing air gaps that could form around the devices which could reduce the overall effectiveness of continuous insulation. Additionally, in some embodiments, the insulation installation sequence described above may be easier than some conventional insulation installation techniques. For example, some conventional installation sequences typically install clips to the building wall, and then install girts on the clips before installing the insulation around the clips. As described above, however, in some embodiments of the present technology the cladding component attachment devices described herein are attached to the building wall 104 before the insulation 106, and then the insulation 106 is installed over/around the attachment devices before the girts or other cladding support components have been installed onto the attachment devices. In some embodiments, this can make it easier to install the insulation 106, as compared to, for example, some systems in which the insulation is installed after the girts have been installed.

It will be appreciated that the piercing tool 900 is but one example of a piercing tool that can be used with the attachment devices 110 and 120 described herein to facilitate installation of insulation over the attachment devices. Accordingly, various other types of piercing tools can be used for this purpose, and in yet other embodiments, no piercing tool at all can be used and instead holes can be cut into the insulation using other methods, and/or other types of insulation can be installed on the wall 104. Accordingly, unless otherwise specified the attachment devices described herein are not limited to use with any particular insulation and/or any particular piercing tool or other tool to facilitate installation of insulation.

Figure 11B:
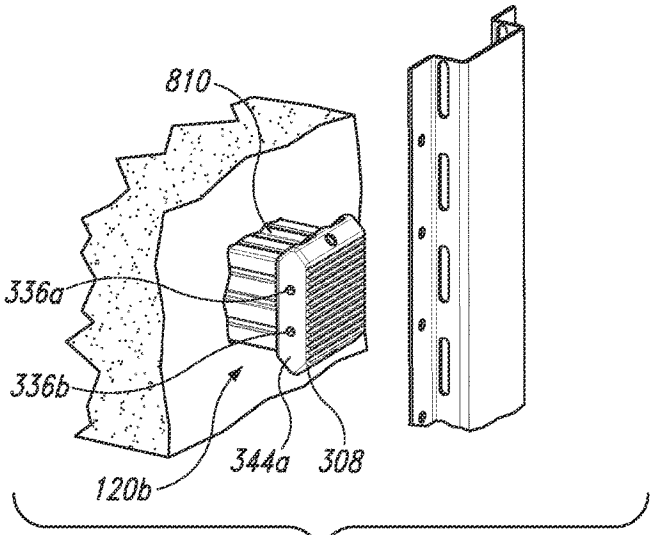
FIGS. 11A-11D are a series of isometric views illustrating various stages of installing a cladding component on a cladding component attachment device in accordance with some embodiments of the present technology.
Figure 11D:
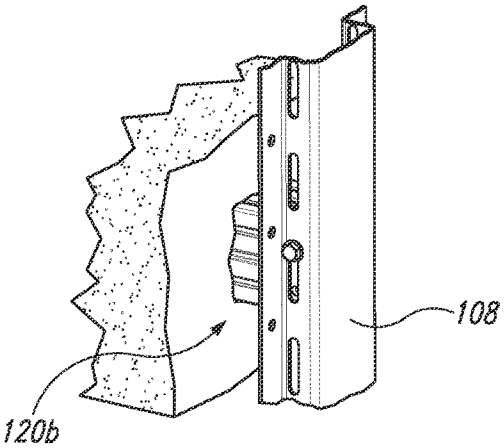
Figure 11A:
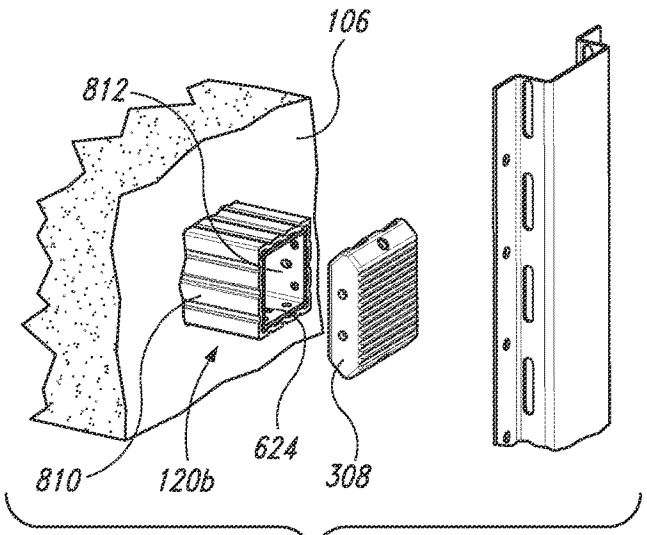

FIGS. 11A-11D are a series of isometric views illustrating various stages in a method for attaching a girt 108 to the distal end portion of the attachment device 120*b*. By way of example, the discussion that follows describes the girt attachment process in the context of the attachment device 120*b*. However, the attachment process shown and described applies equally to the other cladding component attachment devices described herein (e.g., the attachment devices 110*a, b* and 120*a*). Referring first to FIG. 11A, after the insulation 106 has been installed around the attachment device 120*b* and optionally fastened or strapped to the wall 104 (FIG. 9C) using known methods, a distal end portion of the support arm 812 covered by the sleeve 810 will protrude outwardly from the exterior surface of the insulation 106 as shown in FIG. 11A. As shown in FIG. 11B, the end cap 308 can then be positioned on the distal end portion of the support arm 812 as described above with reference to, e.g., FIGS. 6B and 6C.

Figure 11C:
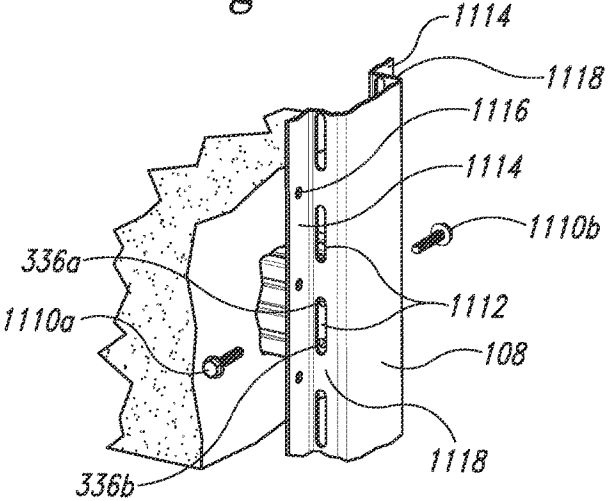

Referring next to FIG. 11C, in the illustrated embodiment, the girt 108 has a "hat-shaped" cross-section having flanges 1114 that extend outwardly from opposing, parallel side walls 1118. The side walls 1118 can include a series of equally-spaced elongate or slotted holes 1112, and each of the flanges 1114 can include a series of equally-spaced holes 1116. To install the girt 108 on the end cap 308 in this embodiment, the girt 108 is positioned over the end cap 308 such that the inner surfaces of the side walls 1118 are positioned in contact with, or at least directly adjacent to, the perpendicular side surfaces 344*a, b* on opposite sides of the end cap 308 (FIG. 11B). Fasteners 1110*a* and 1110*b* (e.g., self-tapping fasteners) can then be inserted through the slotted holes 1112 on each side of the end cap 308 that expose at least one of the fastener holes (e.g., dimples) 336*a, b*, and through the exposed fastener hole 336*a, b*, through the underlying portion of the sleeve 810, and threadably engaged with the corresponding fastener hole 626*a, b* (FIG. 6A) in the distal end portion of the support arm 812 to fixedly attach the girt 108 to the attachment device 120*b*, as shown in FIG. 11D. In the illustrated embodiment, the fastener holes 336*a, b* and the slotted holes 1112 are sized and/or spaced such that at least one of the fastener holes 336*a, b* will be exposed (accessible) regardless of the vertical positioning of the girt 108 relative to the end cap 308 in FIG. 11C. Although the girt 108 shown in FIGS. 11A-11D has a hat-shaped cross-section for purposes of illustration, the cladding component attachment devices described herein are not limited to use with hat-section or "hat-channel" girts, and can be used to support girts and rails having other cross-sectional shapes, such as C-shapes, L-shapes, Z-shapes, flat shapes, etc. In some embodiments, for example, depending on the particular girt or rail configuration, the girt or rail can be fastened to the end cap 308 and the support arm 812 with one or more fasteners that only extend through one or more of the fastener holes 336*a, b* and the corresponding fastener holes 626*a, b* on one side of the end cap 308.

As will be clear from the foregoing discussion, the end cap 308 can be positioned on the distal end portion of the support arm 812 in two different orientations positioned at 90° to each other. For example, if it is desired to attach the girt 108 in a vertical orientation as shown in FIGS. 11A-11D, the end cap 308 can be positioned on the support arm 812 such that the side surfaces 344*a, b* extend vertically, while the angled side surfaces 342*a, b* (FIG. 3A) of the end cap 308 extend horizontally. Conversely, if it is desired to attach the girt 108 in the horizontal orientation, the end cap 308 can be rotated 90° relative to the position shown in FIGS. 11A and 11B such that the surfaces 344*a, b* are oriented horizontally and the surfaces 342*a, b* are oriented vertically. As described below in reference to FIGS. 13A and 13B, in some embodiments, girts, rails and/or other cladding support components having one or more angled flanges, angled side walls, or other angled surfaces can be mounted to the end cap 308 by positioning the angled surfaces of the cladding support component against the angled surfaces 342*a, b* (FIG. 3A) of the end cap 308. Such cladding support components can then be attached to the attachment device 110*a, b* and/or 120*a, b* by inserting the fasteners 316*a, b* (FIG. 3A) through holes in the angled surfaces of the cladding support component, through the dimples 334*a, b* in the end cap 308 (FIG. 3A), and then into the corresponding fastener holes 324 (for the devices 110*a, b*; FIG. 3A) or the corresponding fastener holes 624 (for the devices 120*a, b*; FIG. 6A).

Although, in some embodiments, girts, rails, adapters, and/or other cladding components can be attached to the attachment devices 110*a, b* and 120*a, b* by use of the end cap 308 as described above, in other embodiments, the end cap 308 can be omitted and the girt, rail, etc. can be attached to the body 302 of the attachment device 110*b*, or to the support arm 612, 812 of the attachment devices 120*a, b*, respectively, without use of the end cap 308. For example, with reference to FIG. 11C, in some embodiments, the end cap 308 can be omitted and the girt 108 or other component can be attached to the distal end portion of the attachment device 120*b* by inserting the fasteners 1110*a, b* through the corresponding slotted holes 1112 in the girt 108, through the end portion of the sleeve 810, and then into the corresponding fastener hole 626*a* or 626*b* in the distal end portion of the support arm 812. In further embodiments, the sleeve 810 can also be omitted. Accordingly, it will be understood that embodiments of the cladding component attachment devices 110*a*, b and 120*a, b* described herein are limited to use with the end cap 308 and/or the sleeve 310, 610, 810, and some embodiments of the present technology can be used without the end cap 308 and/or the sleeve 310, 610, 810.

Figure 12B:
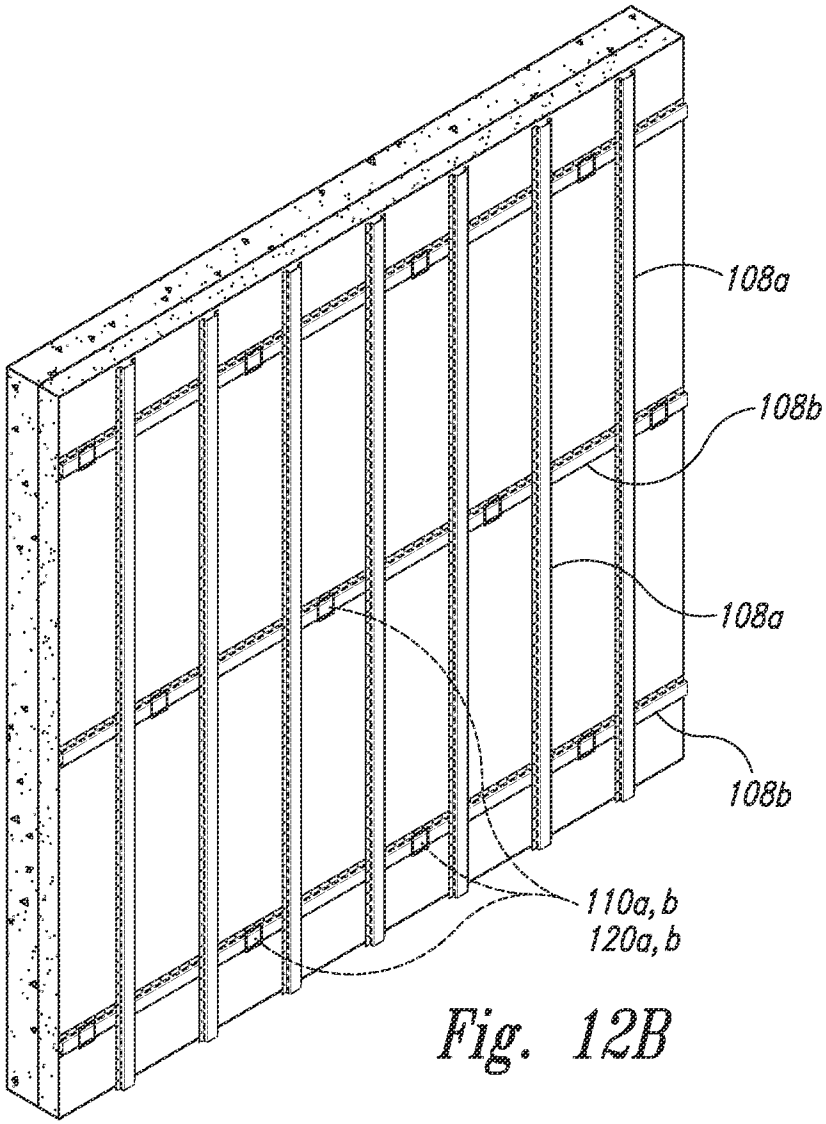
FIGS. 12A and 12B are isometric views of exterior wall assemblies having different cladding support arrangements configured in accordance with some embodiments of the present technology.
Figure 12A:
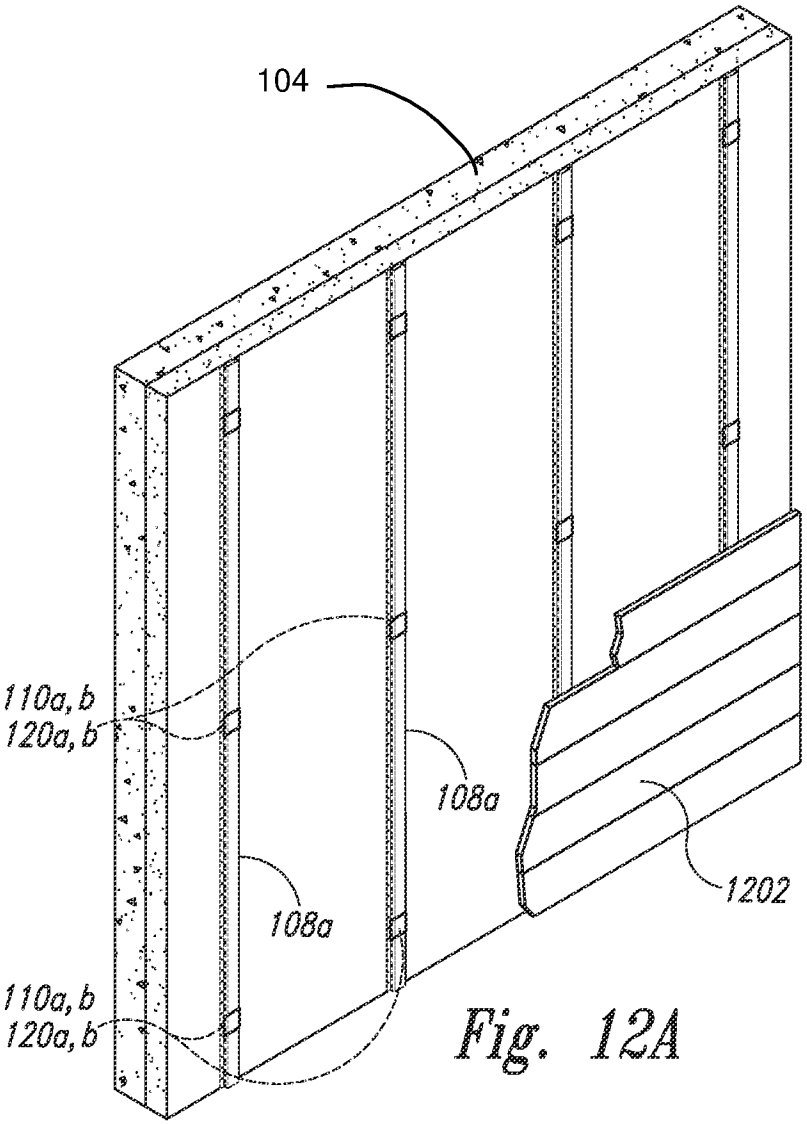

The cladding component attachment devices 110*a, b* and 120*a, b* described in detail herein can be used to attach girts, rails and/or other cladding components to wall structures in a wide variety of arrangements and orientations to suit particular applications and/or load requirements. As shown in FIG. 12A, for example, in some embodiments, the attachment devices 110 or 120 can be used to attach a plurality of girts 108*a* to the wall 104 in a vertical orientation. Various types of cladding 1202 can then be fastened to the vertical girts 108*a* using any suitable methods and systems known in the art. By way of nonlimiting example, such cladding can include extruded aluminum siding, other types of metal siding and panels, fiber cement siding, phenolic siding, composite siding, etc. As shown in FIG. 12B, for higher design loads (e.g., higher wind loads), a plurality of first girts 108*b* can be attached to the devices 110 or 120 in a horizontal orientation, and then an arrangement of second girts 108*a* can be attached to the horizontal girts 108*a* in a vertical orientation (using, e.g., sheet metal screws and/or other known methods) for a combination of horizontally and vertically positioned girts. The cladding 1202 can then be fastened to the vertical girts 108*a*. The attachment devices 110 and 120 can be attached to the wall 104 at different spacings depending on the design loads. By way of example only, in some embodiments, the attachment devices 110 and 120 can be positioned at a 32 inch lateral spacing and a 48 inch vertical spacing to support an arrangement of vertical girts 108*a* (as shown in FIG. 12A) and sustain a design wind load of, e.g., less than 40 pounds per square foot on the cladding 1202. By way of another example, the attachment devices 110 and 120 can be positioned at a staggered 32 inch lateral spacing and a 48 inch vertical spacing to support an arrangement of vertical girts 108*a* and horizontal girts 108*b* (as shown in FIG. 12B) and sustain a higher design wind load of, e.g., greater than 40 pounds per square foot on the cladding 1202.

Figure 13A:
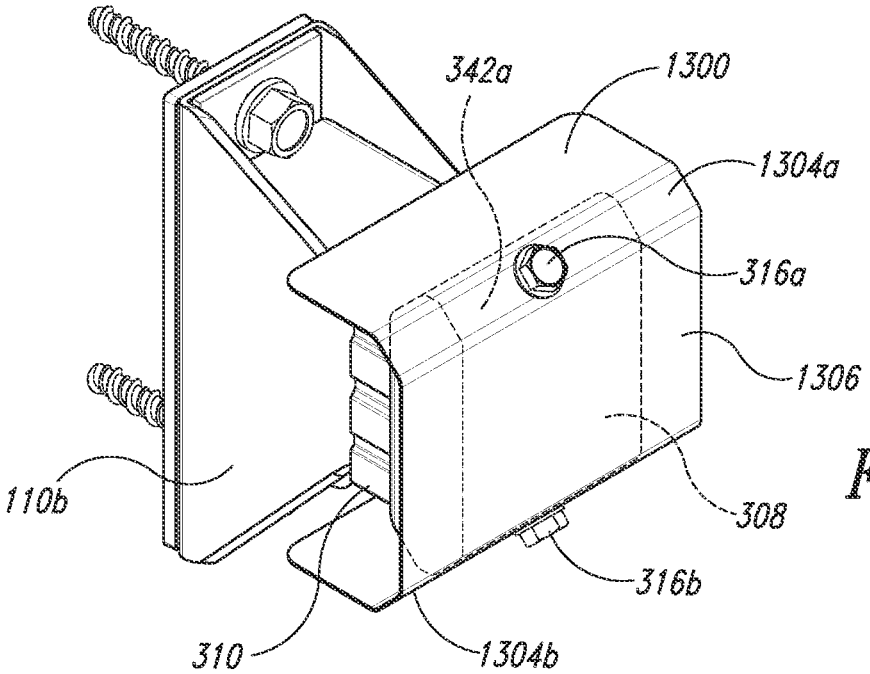
FIG. 13A is an isometric view illustrating a cladding component attachment accessory installed on a cladding component attachment device in accordance with some embodiments of the present technology.
Figure 13B:
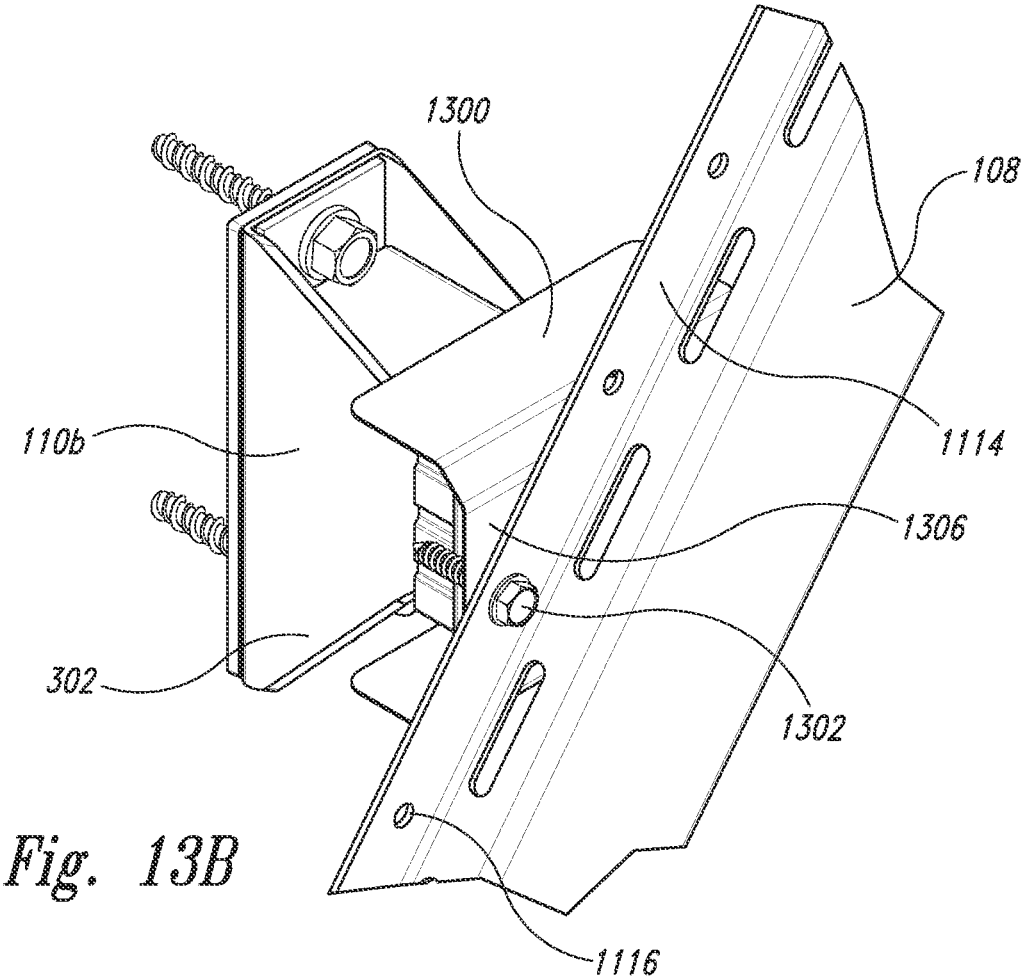
FIG. 13B is an isometric view of a cladding component installed on the accessory in accordance with some embodiments of the present technology.

FIG. 13A is an isometric view of an adapter 1300 attached to the cladding component attachment device 110*b* in accordance with embodiments of the present technology, and FIG. 13B is an isometric view of a girt 108 attached to the adapter 1300. Referring first to FIG. 13A, by way of example the adapter 1300 is installed on the distal end portion of the cladding component attachment device 110*b*. However, the adapter 1300 can mounted to any of the attachment devices 110*a, b* or 120*a, b* described in detail above, either in place of the end cap 308 or by attaching the adapter 1300 to the attachment device by means of the end cap 308. For example, in the illustrated embodiment, the adapter 1300 has an open channel or "C-channel" cross-section with a web 1306 and beveled or angled corner walls 1304*a* and 1304*b* on each side thereof. The adapter 1300 can be attached to the device 110*b* by inserting the fasteners 316*a, b* through holes in the beveled walls 1304*a, b*, through the dimples 334*a, b* in the angled side surfaces 342*a, b* of the end cap 308, and through the corresponding holes 324 in the third and fourth side walls 322*a* and 322*b*, respectively, of the body 302 (FIG. 3A). Referring next to FIG. 13B, once the adapter 1300 has been attached to the distal end portion of the attachment device 110*b* in the foregoing manner, the web 1306 provides a flat, unobstructed surface onto which the girt 108, or other girts, rails, etc. having other configurations, can be fastened at essentially any desired angle using fasteners 1302 (e.g., self-tapping fasteners) that extend through the holes 1116 in the flange 1114 and through the web 1306 of the adapter 1300.

Figure 14B:
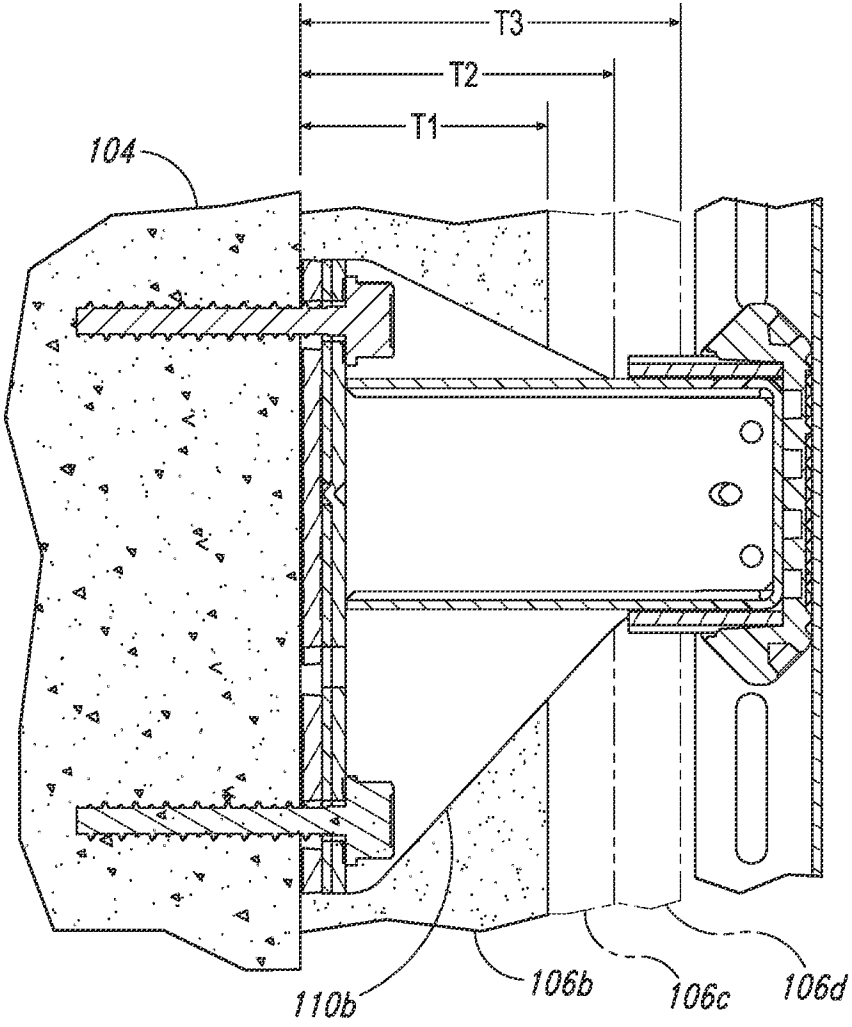
FIGS. 14A-14D are cross-sectional side views of various cladding component attachment device installations configured in accordance with some embodiments of the present technology.
Figure 14A:
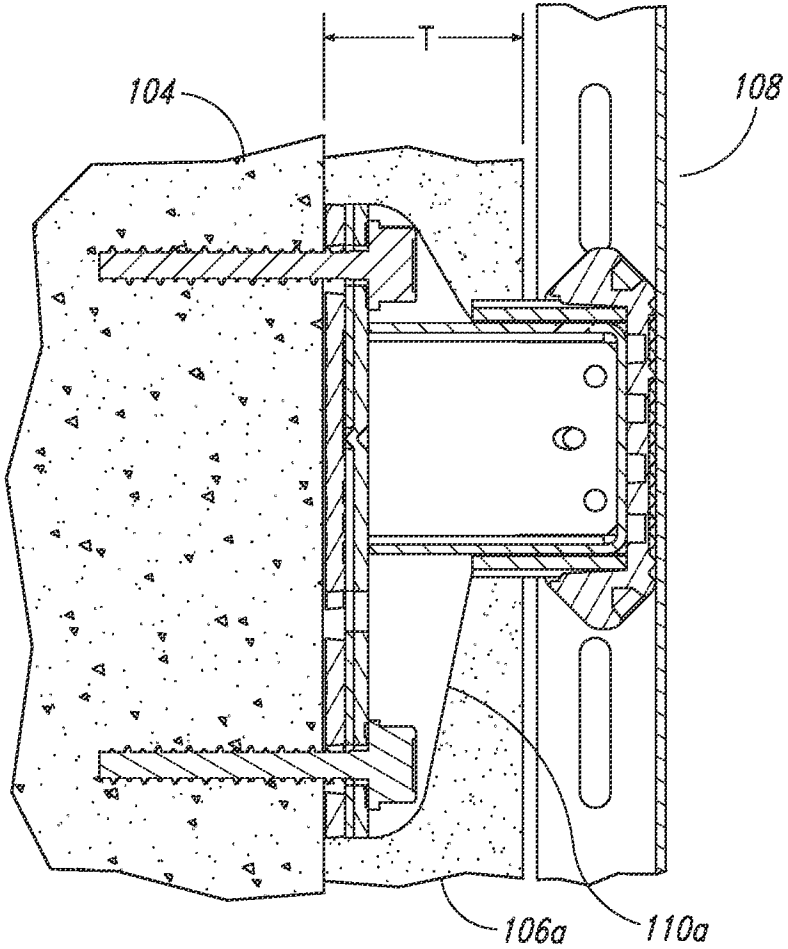
Figure 14C:
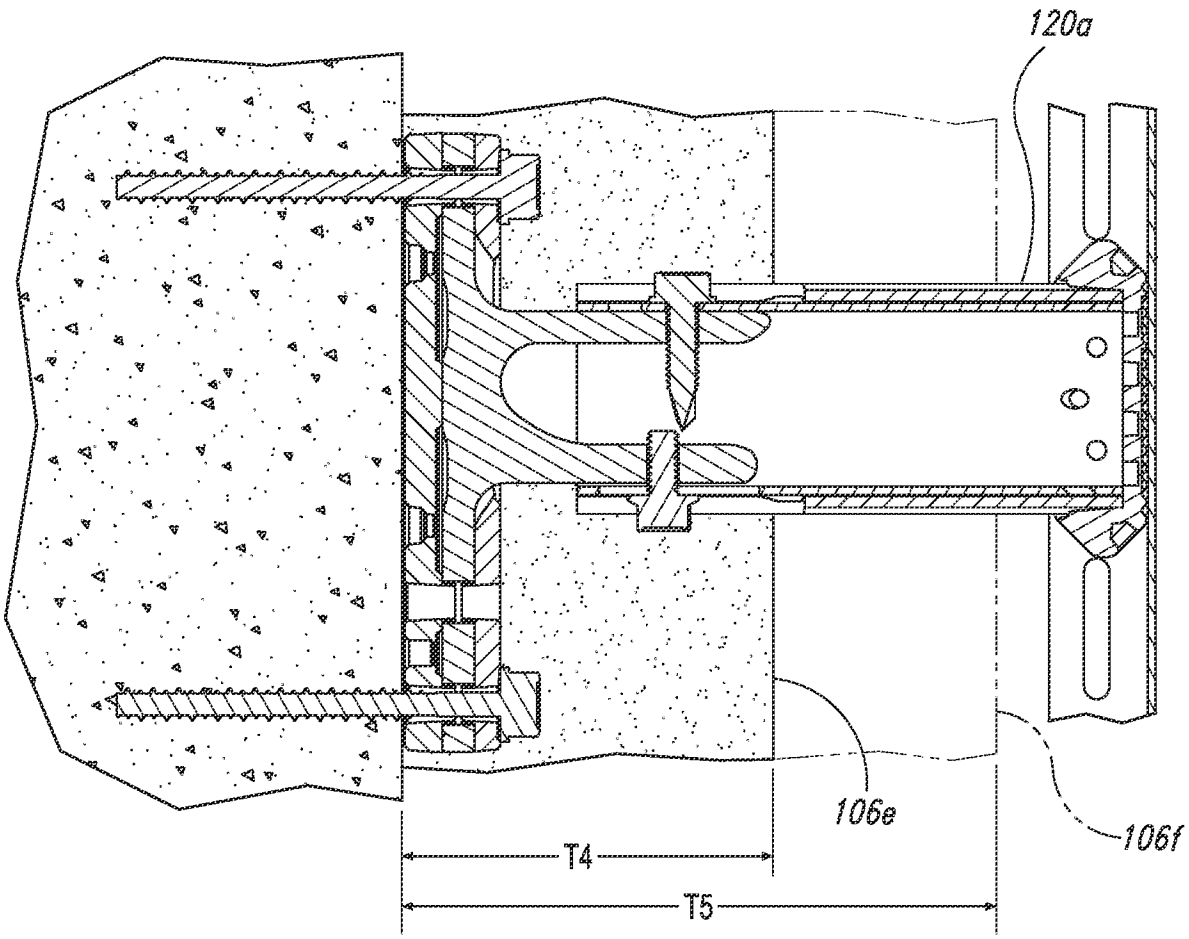
Figure 14D:
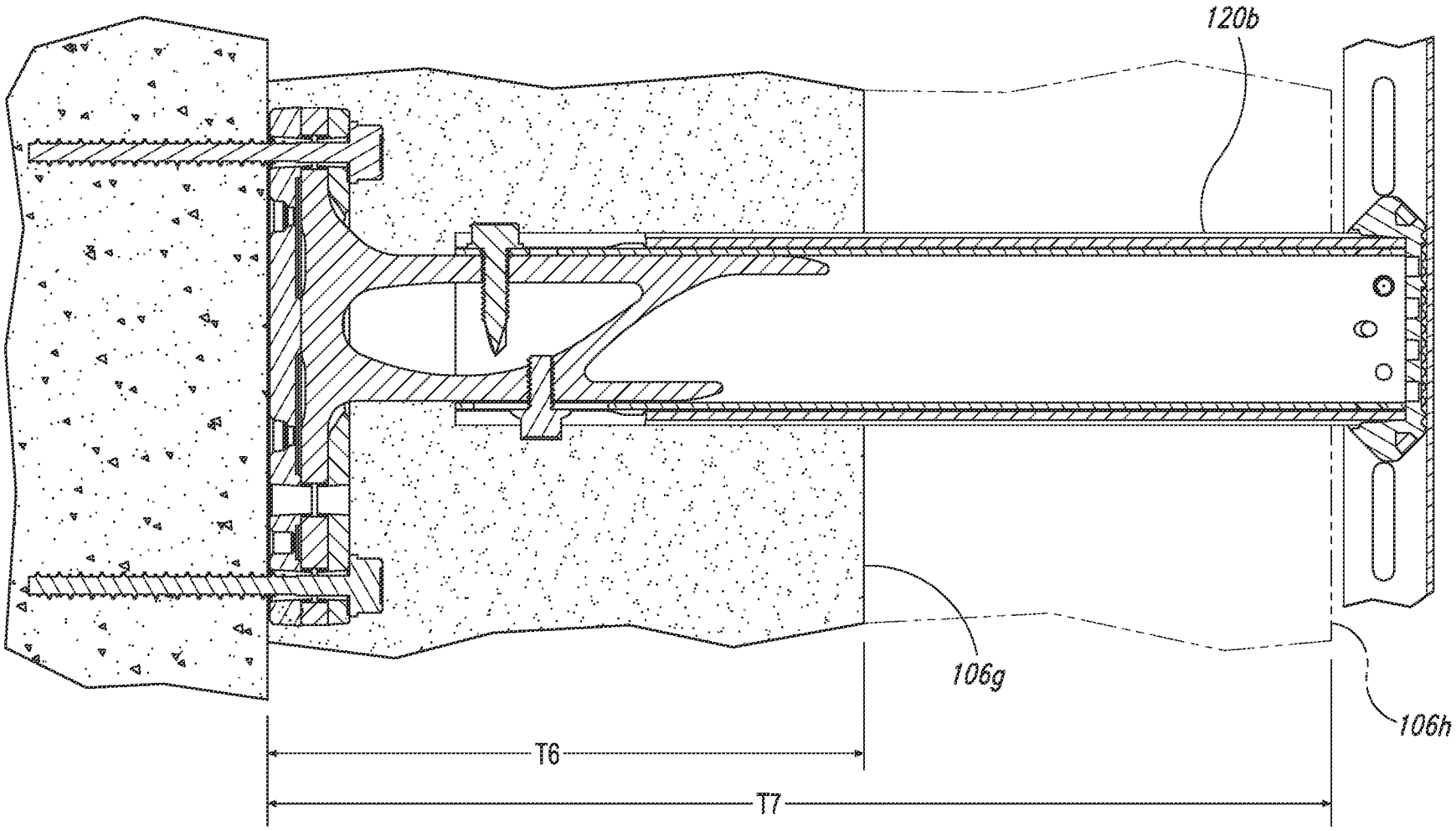

FIGS. 14A-14C are cross-sectional side views illustrating example installations of the cladding component attachment devices 110*a, b* and 120*a, b*, respectively, on a wall 104 having a range of different exterior insulation thicknesses. Referring first to FIG. 14A, in some embodiments, the attachment device 110*a* can be used with insulation 106*a* having a thickness T of, e.g., up to 1 inch, or about 1 inch. As shown in FIG. 14B, in some embodiments, the attachment device 110*b* can be used with insulation 106*b-d* having, e.g., a thickness T1 of about 1.5 inches; a thickness T2 of about 2 inches; or a thickness T3 of about 2.5 inches, respectively. Turning next to FIG. 14C, in those applications having thicker insulation, the attachment device 120*a* can be used with insulation 106*e* having, e.g., a thickness T4 of about 3 inches, as well as other insulation 106*f* having a thickness T5 ranging from about 3 inches to about 6 inches. Additionally, in those embodiments in which the attachment device 120*a* includes a longer support arm 612 (FIG. 6A) than is depicted in FIG. 14C, the attachment device 120*a* can also be used with insulation 106*f* having thicknesses greater than 6 inches, such as a thickness T5 ranging from about 6 inches to about 24 inches, or from about 6 inches to about 15 inches. As shown in FIG. 14D, in some embodiments the attachment device 120*b* can be used with insulation 106*g* having a thickness T6 of up to 6 inches, or about 6 inches, or an insulation 106*h* having a thickness T7 of from about 6 inches to about 36 inches or more, from about 6 inches to about 24 inches, or from about 6 inches to about 15 inches. In other embodiments, the cladding component attachment devices described herein and various embodiments thereof can be used with insulation having thicknesses that are greater than or less than the examples provided above. Moreover, in some embodiments, the attachment devices described herein may be used on walls without insulation. As the foregoing discussion of FIGS. 14A-14D illustrates, the cladding component attachment devices 110*a, b* and 120*a, b* described herein can be used to accommodate a wide range of insulation thicknesses. Moreover, it will be appreciated that the insulation thicknesses provided above, as well as the corresponding dimensions of the attachment devices 110*a, b* and 120*a, b* described above, are provided by way of example only, and embodiments of the attachment devices described herein and configured in accordance with the present technology can have other dimensions without departing from the present disclosure.

The number and spacing of cladding component attachment devices on a building wall is typically determined by the dead load of the cladding, the wind loads, the potential seismic loading, as well as the structural capacity of the individual attachment devices. In general, if the structural capacity of the individual cladding component attachment devices is relatively low, then the attachment devices will have to be placed next to each other in relatively close proximity to carry the applied loads. This can increase the number of attachment devices required for any particular application, which has a tendency to reduce the overall thermal efficiency of the system because of the increased thermal bridging effect caused by the attachment devices. In one aspect of some embodiments of the present technology, the cladding component attachment devices described herein can be positioned at relatively high spacings because of their relatively high structural load capacity, thereby reducing the overall number of attachment devices required for a particular application and, consequently, increasing the overall thermal efficiency of the system. Additionally, due to the relatively high load capacity of some embodiments of the devices described herein, it is contemplated that the devices can also carry a portion of the dead load from the exterior insulation, which can have the additional benefit of reducing the number of anchors or other devices needed to support the insulation. This can result in cost savings and reduce the amount of penetrations in the insulation, which can potentially compromise the air and vapor barrier between the building wall and the cladding. Additionally, some embodiments of the cladding attachment systems described herein can also reduce thermal bridging by use of materials and thermal break components (e.g., the end caps 308, the base plates 306 and 606, the sleeves 310 and 610, etc.) which reduce thermal conduction. For example, in some embodiments, some of the components (e.g., the body 302, the support arms 612 and 812, etc.) can be made from stainless-steel due to its relatively low thermal conductivity and relatively high tensile strength. Similarly, some embodiments of the thermal break components described above can be made from materials, e.g., glass filled PA6, that provide the benefits of relatively high strength and relatively low thermal conductivity.

A further benefit of some embodiments of the attachment devices described above is that they can accommodate a wide range of insulation thicknesses by simply selecting a support arm (e.g., 612, 812) of appropriate length. Moreover, some embodiments of the attachment devices described above enable the installer to adjust for wall plumbness of up to, e.g., about one inch (or more), using the adjustability features described above. In other embodiments in which more than one inch of adjustability is required, a custom support arm length can be cut on-site to address the installation. Additionally, further benefits of some embodiments include the ability to stack multiple girts or other cladding attachment components in either a horizontal or vertical orientation (or other angular orientations), as well as the ability to stack multiple girts or other cladding component supports on top of each other to further augment available design options.

References throughout the foregoing description to features, advantages, benefits, or similar language do not imply that all of the features and advantages that may be realized with the present technology should be or are in any single embodiment of the invention. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment. Furthermore, the described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology.

Any patents and applications and other references noted above, including any that may be listed in accompanying filing papers, are incorporated herein by reference in the entirety, except for any subject matter disclaimers or disavowals, and except to the extent that the incorporated material is inconsistent with the express disclosure herein, in which case the language in this disclosure controls. Aspects of the invention can be modified, if necessary, to employ the systems, functions, and concepts of the various references described above to provide yet further implementations of the invention.

The above Detailed Description of examples and embodiments of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further any specific numbers noted herein are only examples: alternative implementations may employ differing values or ranges.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

Although certain aspects of the invention are presented below in certain claim forms, the applicant contemplates the various aspects of the invention in any number of claim forms. Accordingly, the applicant reserves the right to pursue additional claims after filing this application to pursue such additional claim forms, in either this application or in a continuing application.

We claim:

1. A device for attaching a cladding component to an exterior wall of a building, the device comprising:

a base configured to be attached to the exterior wall of the building, wherein the base includes— a first base flange, a second base flange, a first support flange extending outwardly relative to the first and second base flanges, and a second support flange extending outs outwardly relative to the first and second base flanges, wherein the first base flange and the second base flange collectively have a plurality of first fastener holes, and wherein the plurality of first fastener holes includes at least one first fastener hole in the first base flange and at least one other first fastener hole in the second base flange;

a first base plate configured to be positioned against a first side of the first and second base flanges, wherein the first base plate includes a plurality of second fastener holes positioned to align with corresponding ones of the plurality of first fastener holes;

a second base plate configured to be positioned against a second side of the first and second base flanges, the second side being opposite the first side, such that, when assembled, the first and second base flanges are sandwiched between the first base plate and the second base plate, wherein the second base plate includes— an aperture configured to receive the first support flange and the second support flange, and a plurality of third fastener holes positioned to align with corresponding ones of the plurality of first fastener holes; and a tubular member having a proximal end portion spaced apart from a distal end portion, wherein the proximal end portion is configured to receive and be attached to the first support flange and the second support flange with the distal end portion extending outwardly from the base, and wherein the distal end portion is configured to be attached to the cladding component.

2. The device of claim 1 wherein the tubular member has a rectangular cross-section.

3. The device of claim 1 wherein the tubular member has a square cross-section.

4. The device of claim 1 wherein the proximal end portion of the tubular member includes a fourth fastener hole and the second support flange includes a fifth fastener hole, wherein the fourth fastener hole is an elongate fastener hole configured to receive a fastener extending therethrough that is threadably received in the fifth fastener hole to attach the tubular member to the second support flange, and wherein the elongate fourth fastener hole enables the position of the distal end portion of the tubular member to be adjusted relative to the base.

5. The device of claim 1 wherein the tubular member includes a plurality of side walls defining an interior portion, and wherein the first and second support flanges are configured to be inserted into the interior portion.

6. The device of claim 1 wherein the base is formed from an extrusion such that the first base flange, the second base flange, the first support flange, and the second support flange comprise a unitary structure.

7. The device of claim 1 wherein the distal end portion of the tubular member includes one or more fourth fastener holes configured to receive a fastener for attaching the cladding component to the device.

8. The device of claim 1 wherein the distal end portion of the tubular member includes one or more fourth fastener holes configured to receive a fastener for selectively attaching the cladding component to the device in a first orientation or a second orientation positioned at 90 degrees relative to the first orientation.

9. The device of claim 1, further comprising a cap configured to be coupled to the distal end portion of the tubular member and positioned between the cladding component and the device.

10. The device of claim 9 wherein the cap includes a recess configured to receive the distal end portion of the tubular member.

11. The device of claim 10 wherein the cap is an insulative cap formed from non-metallic material.

12. The device of claim 1 wherein:

one of the first and second base plates includes a plurality of tabs; and the other of the first and second base plates includes a plurality of recesses sized and shaped to receive the plurality of tabs to couple the second base plate to the first base plate.

13. The device of claim 1 wherein the first base plate and the second base plate are composed at least partially of an insulative material having a lower thermal conductivity than the base.

14. The device of claim 1, further comprising a tubular sleeve sized and shaped to receive the tubular member, wherein the tubular sleeve is composed of an insulative material having a lower thermal conductivity than the tubular member.

15. A device for attaching a cladding component to a wall of a building, the device comprising:

a base configured to be attached to the wall of the building, wherein the base includes— one or more base flanges configured to receive one or more fasteners for attaching the base to the wall of the building, a first support flange extending outwardly from the one or more base flanges, and a second support flange extending outwardly from the one or more base flanges;

a first base plate configured to be positioned between the wall of the building and the one or more base flanges, wherein the first base plate has a lower thermal conductivity than the base;

a second base plate configured to be positioned against the one or more base flanges opposite the first base plate to sandwich the one or more base flanges therebetween, wherein the second base plate has a lower thermal conductivity than the base; and a tubular member having a proximal end portion spaced apart from a distal end portion, wherein the proximal end portion is configured to be attached to the first support flange and the second support flange, and wherein the distal end portion is configured to be attached to the cladding component.

16. The device of claim 15, further comprising a tubular sleeve sized and shaped to receive the tubular member, wherein the tubular sleeve has a lower thermal conductivity than the tubular member.

17. The device of claim 15, further comprising a cap configured to be coupled to the distal end portion of the tubular member and positioned between the cladding component and the tubular member, wherein the cap has a lower thermal conductivity than the tubular member.

18. The device of claim 15 wherein the first base plate and the second base plate are composed of a thermoplastic material.

19. A device for attaching a cladding component to an exterior wall of a building, the device comprising:

a base configured to be attached to the exterior wall of the building, wherein the base includes— one or more base flanges configured to receive one or more fasteners for attaching the base to the exterior wall of the building, a first support flange extending outwardly from a first side of the one or more base flanges, and a second support flange extending outwardly from the first side of the one or more base flanges, and a reinforcing web extending between the first support flange and the second support flange;

a first base plate configured to be positioned against a second side of the one or more base flanges, the second side being opposite the first side;

a second base plate configured to be positioned against the first side of the one or more base flanges such that, when assembled, the one or more base flanges are positioned between the first base plate and the second base plate; and a tubular member having a proximal end portion spaced apart from a distal end portion, wherein the proximal end portion is configured to be attached to the first and second support flanges, and wherein the distal end portion is configured to be attached to the cladding component.

20. The device of claim 19 wherein the base is a unitary structure.

21. The device of claim 19, further comprising:

a tubular sleeve sized and shaped to receive the tubular member; and a cap configured to be coupled to the distal end portion of the tubular member and positioned between the cladding component and the tubular member, wherein the tubular sleeve and the cap have a lower thermal conductivity than the tubular member.

22. The device of claim 19 wherein the first support flange has a first length and the second support flange has a second length different than the first length.

* * * * *